US010373569B2

(12) United States Patent
Ninan et al.

(10) Patent No.: US 10,373,569 B2
(45) Date of Patent: Aug. 6, 2019

(54) DISPLAY LIGHT SOURCE TIMING

(71) Applicant: Dolby Laboratories Licensing Corporation, San Francisco, CA (US)

(72) Inventors: Ajit Ninan, San Jose, CA (US); Chun Chi Wan, Campbell, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 258 days.

(21) Appl. No.: 15/366,319

(22) Filed: Dec. 1, 2016

(65) Prior Publication Data

US 2017/0162107 A1 Jun. 8, 2017

Related U.S. Application Data

(60) Provisional application No. 62/264,482, filed on Dec. 8, 2015.

(51) Int. Cl.
*G09G 3/34* (2006.01)

(52) U.S. Cl.
CPC ..... *G09G 3/3426* (2013.01); *G09G 2320/064* (2013.01); *G09G 2320/0633* (2013.01); *G09G 2320/0653* (2013.01); *G09G 2360/16* (2013.01)

(58) Field of Classification Search
CPC ..... G09G 3/3426; G09G 2320/0633; G09G 2320/064; G09G 2320/0653; G09G 2360/16
See application file for complete search history.

(56) References Cited

U.S. PATENT DOCUMENTS 7,842,217 B2 11/2010 Enns
2005/0248553 A1* 11/2005 Feng ..... G09G 3/3426 345/204
2007/0063940 A1* 3/2007 Juenger ..... G09G 3/3611 345/87
2009/0262064 A1* 10/2009 Li ..... G09G 3/342 345/102
2009/0322800 A1 12/2009 Atkins
2010/0020002 A1* 1/2010 Van Woudenberg ..... G09G 3/342 345/102
2011/0169881 A1 7/2011 Wallener
2012/0075360 A1* 3/2012 Messmer ..... G09G 3/3406 345/690
2012/0081419 A1 4/2012 Abe
(Continued)

FOREIGN PATENT DOCUMENTS

WO WO 2014116715 A1 * 7/2014 ..... H04N 5/57

*Primary Examiner* — Mark Edwards

(57) ABSTRACT

A first and a second light valve control values are derived for a first and a second frames, respectively, in a specific region of a display panel based on image data of the first and second frames. It is determined whether a difference between the first and second light valve control values exceeds a light valve control threshold. If so, a light source driving waveform is constructed to comprise a sequence of light source control pulses for controlling one or more light sources designated to illuminate the specific region of the display panel. The sequence of light source control pulses is constrained to start at a start time plus a transition time interval. The transition time interval allows light valves in the specific region of the display panel to complete a transition between the first and second light valve control values.

27 Claims, 23 Drawing Sheets

(56) References Cited

U.S. PATENT DOCUMENTS

| | | | | |
|---|---|---|---|---|
| 2012/0169802 | A1* | 7/2012 | Hasegawa | G09G 3/2018 345/691 |
| 2015/0228219 | A1 | 8/2015 | Noiman | |

* cited by examiner

DISPLAY LIGHT SOURCE TIMING

CROSS REFERENCE TO RELATED APPLICATIONS

This application claims the benefit of priority to U.S. Patent Application No. 62/264,482, filed Dec. 8, 2015, which is hereby incorporated herein by reference in its entirety.

TECHNOLOGY

The present invention relates generally to display light sources, and in particular, to display light source timing.

BACKGROUND

A display device may comprise light sources that generate illumination on pixels implemented as light valves with light modulation layers of the display device. A light valve may be set to a light transmittance in a light transmittance range. For example, in a first frame of a scene that depicts motions, to generate a dark black level for a pixel, a corresponding light valve may be set to a small light transmittance. In a second frame immediately following the first frame, to generate a high brightness level for the pixel, the same light valve may be set to a large light transmittance.

However, it takes time to settle physical state changes in a light valve. For example, it takes time to transition the light valve to different specific light transmittances from one frame to the next frame. A pixel that corresponds to the light valve may have incorrect transient brightness levels while the light valve undergoes changes in light transmittances. As a result, visual artifacts such as blurs, jitters, etc., may be generated in rendering some images, especially those involving motions.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF DRAWINGS

The present invention is illustrated by way of example, and not by way of limitation, in the figures of the accompanying drawings and in which like reference numerals refer to similar elements and in which.

DESCRIPTION OF EXAMPLE POSSIBLE EMBODIMENTS

Figure 1A:
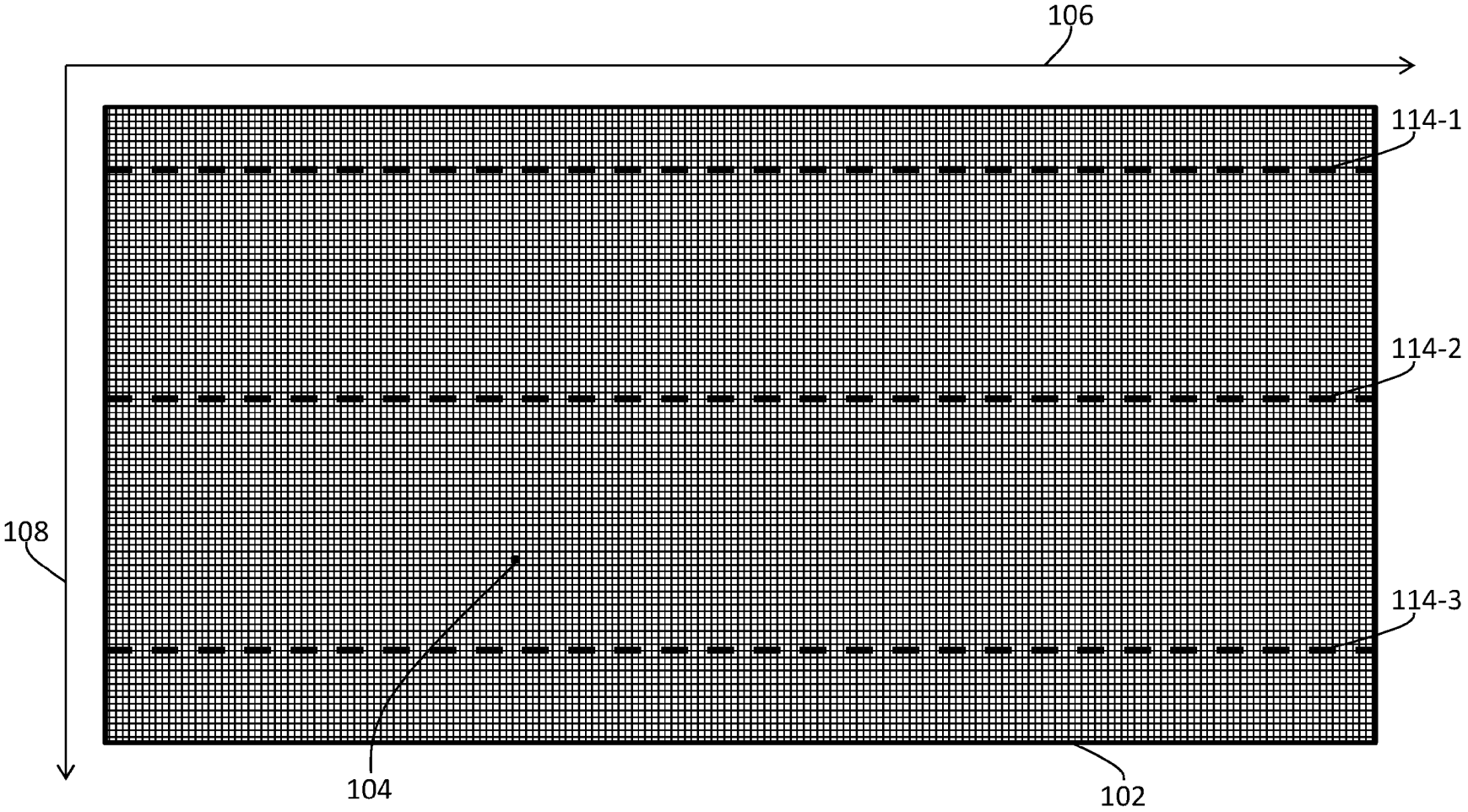
FIG. 1A illustrates an example display panel.

Example possible embodiments, which relate to display light source timing, are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily occluding, obscuring, or obfuscating the present invention.

Example embodiments are described herein according to the following outline:

1. GENERAL OVERVIEW
2. STRUCTURE OVERVIEW
3. IMAGE DATA OF FRAMES
4. LIGHT OUTPUT REGULATION PROPERTY
5. LIGHT SOURCE CONTROL WAVEFORMS
6. EXAMPLE SYSTEM CONFIGURATIONS
7. EXAMPLE PROCESS FLOW
8. IMPLEMENTATION MECHANISMS—HARDWARE OVERVIEW
9. EQUIVALENTS, EXTENSIONS, ALTERNATIVES AND MISCELLANEOUS

1. General Overview

This overview presents a basic description of some aspects of a possible embodiment of the present invention. It should be noted that this overview is not an extensive or exhaustive summary of aspects of the possible embodiment. Moreover, it should be noted that this overview is not intended to be understood as identifying any particularly significant aspects or elements of the possible embodiment, nor as delineating any scope of the possible embodiment in particular, nor the invention in general. This overview merely presents some concepts that relate to the example possible embodiment in a condensed and simplified format, and should be understood as merely a conceptual prelude to a more detailed description of example possible embodiments that follows below.

Techniques as described herein can be used by a high dynamic range (HDR) display device to render images of a high dynamic range (e.g., 2,000 nits, 10,000 nits, 20,000 nits or more, etc.) that is multiple times (e.g., five times, ten times, over ten times, etc.) higher than a relatively narrow dynamic range (e.g., 300 nits, 500 nits, 1,000 nits, etc.) supported by a standard dynamic range (SDR) display device. These techniques prevent visual artifacts such as blurs, jitters, etc., caused by incorrect transient brightness levels in other approaches while light valves undergoes changes in light output regulation properties. A display device such as a television, a local dimming display, a set-top box operating in conjunction with a display, etc., can apply these techniques to construct specific sequences of light source control pulses (or light source driving pulses) that minimize blurs, jitters, etc., from one frame to the next frame and drive light sources that illuminate regions of a target display panel with these specific sequences of light source control pulses.

In some example embodiment, image data for a sequence of frames is received. Based at least in part on first image data of a first frame, a first light valve control value is derived for the first frame in a specific region of a display panel. The first image data of the first frame is to be rendered on the display panel starting at a first frame time. Based at least in part on second image data of a second frame that immediately follows the first frame in time, a second light valve control value is derived for the second frame in the specific region of the display panel. The second image data of the second frame is to be rendered on the display panel starting at a second frame time.

It is determined whether a difference between the first light valve control value and the second light valve control value exceeds a light valve control threshold. In response to determining that the difference between the first light valve control value and the second light valve control value exceeds the light valve control threshold, the following steps are performed. A light source driving waveform is constructed to comprise a sequence of light source control pulses for controlling one or more light sources designated to illuminate the specific region of the display panel. The sequence of light source control pulses may be constrained to start at a start time. The start time is set to be no earlier than the second frame starting time plus a transition time interval. This transition time interval allows one or more light valves in the specific region of the display panel to complete a transition from the first light valve control value for the first frame to the second light valve control value for the second frame. The one or more light sources are driven with the sequence of light source control pulses in the light source driving waveform as a part of rendering the second image data of the second frame on the display panel.

A light source as described herein may be driven with sequences of light source control pulses based on one or more digital driving techniques, one or more analog driving techniques, or a combination of one or more digital driving techniques and one or more analog driving techniques. Examples of driving techniques include, but are not limited to only, any of: light source control pulse width modulation (PWM), light source control pulse code modulation (PCM), light source control pulse density modulation (PDM), etc.

Additionally, optionally, or alternatively, in response to determining that the difference between the first light valve control value and the second light valve control value exceeds the light valve control threshold, the following steps are performed. Time-dependent light output regulation property values in the specific region of the display panel are determined within a frame time interval that starts at the second frame start time. Based on the time-dependent light output regulation property values in the specific region of the display panel, a light source driving waveform is constructed to comprise a sequence of light source control pulses. The sequence of light source control pulses may be constrained to generate a smooth light output over (e.g., throughout) the frame time interval. One or more light sources that are designated to illuminate the specific region are driven with the sequence of light source control pulses in the light source driving waveform as a part of rendering the second image data of the second frame on the display panel.

In some embodiments, a method comprises providing an image processing system as described herein. In some possible embodiments, mechanisms as described herein form a part of a system, including but not limited to a studio display system, a professional display device, a home-based display device, a theater-based display device, an image processing system, an image processing system, a set-top box, an outdoor image display, a television, a handheld device, a game machine, a media content system, a laptop computer, a netbook computer, electronic book reader, desktop computer, computer workstation and various other kinds of terminals and display units.

Various modifications to the preferred embodiments and the generic principles and features described herein will be readily apparent to those skilled in the art. Thus, the disclosure is not intended to be limited to the embodiments shown, but is to be accorded the widest scope consistent with the principles and features described herein.

2. Structure Overview

FIG. 1A illustrates an example display panel 102 that comprises a plurality of pixels (one of which, for example, is a pixel 104). For the purpose of illustration only, the pixels are depicted as being rectangles arranged in an array pattern. In various embodiments, the pixels may be of different shapes other than rectangles. Additionally, optionally, or alternatively, the pixels may be arranged in different patterns (e.g., concentric pattern, a pattern randomized to a certain extent, spherical pattern, etc.) other than the array pattern.

Each pixel (e.g., 104, etc.) as described herein may comprise a set of light valves. For example, each such pixel may comprise a set of three or more subpixels, which corresponds to a set of three or more light valves used to control intensities of different component colors of a color space.

In some embodiments, the display panel (102) is of a transmissive display type; a light valve as described herein can be set to different transmittances (or transparency levels) for the purpose of regulating amounts of light transmitting through the light valve toward a viewer of the display panel (102). As used herein, "transmittance" may refer to the amount of light flux exiting out of a light valve, normalized by the amount of light flux entering into the light valve. In some embodiments, the display panel (102) is of a reflective display type; the light valve can be set to different reflectances for the purpose of regulating amount of light being reflected from the light valve toward a viewer of the display panel (102). As used herein, "reflectance" may refer to the amount of light flux reflected by a light reflector, normalized by the amount of light flux incident onto the light reflector. Additionally, optionally, or alternatively, the display panel (102) is of a transflective display type; transmissive light valves and reflective light valves can be set to different transmittances and different reflectances for the purpose of regulating amount of light transmitting through the transmissive light valves or being reflected from the reflective light valves toward a viewer of the display panel (102).

As used herein, light transmittance of a light valve (e.g., in a transmissive display, in a transflective display, etc.) and/or light reflectance of a light valve (e.g., in a reflective display, in a transflective display, etc.) may be individually or in combination referred to as a light output regulation property of the light valve. The light output regulation property of the light valve may be controlled or set with a light valve control (e.g., a light source driving voltage, a voltage applied to electrodes of a pixel or a subpixel represented by the light valve, etc.) applied to the light valve. A pixel or a subpixel may, but is not required to, contain a single light valve.

Light sources in an image processing system as described herein can be arranged in various spatial distributions. FIG.

1B illustrates an example spatial distribution 110 of light sources (e.g., 112-1, 112-2, 112-3, etc.). For the purpose of illustration only, light sources (or light emitters) in the spatial distribution (110) are arranged in a two-dimensional array at centers and vertexes of a plurality of hexagons. In some embodiments, the light sources may be mounted on one or more circuit boards that form a plane (which can be parallel to a planar surface of one or more light valve layers (e.g., LCD layers, etc.) in the display panel (102). It should be noted that other spatial distributions (e.g., vertices of a rectangular grid, etc.) may be used to place the light sources in a two-dimensional array. Additionally, optionally, or alternatively, other arrangements of the light sources other than the two-dimensional array may also be used in various embodiments.

Figure 1B:
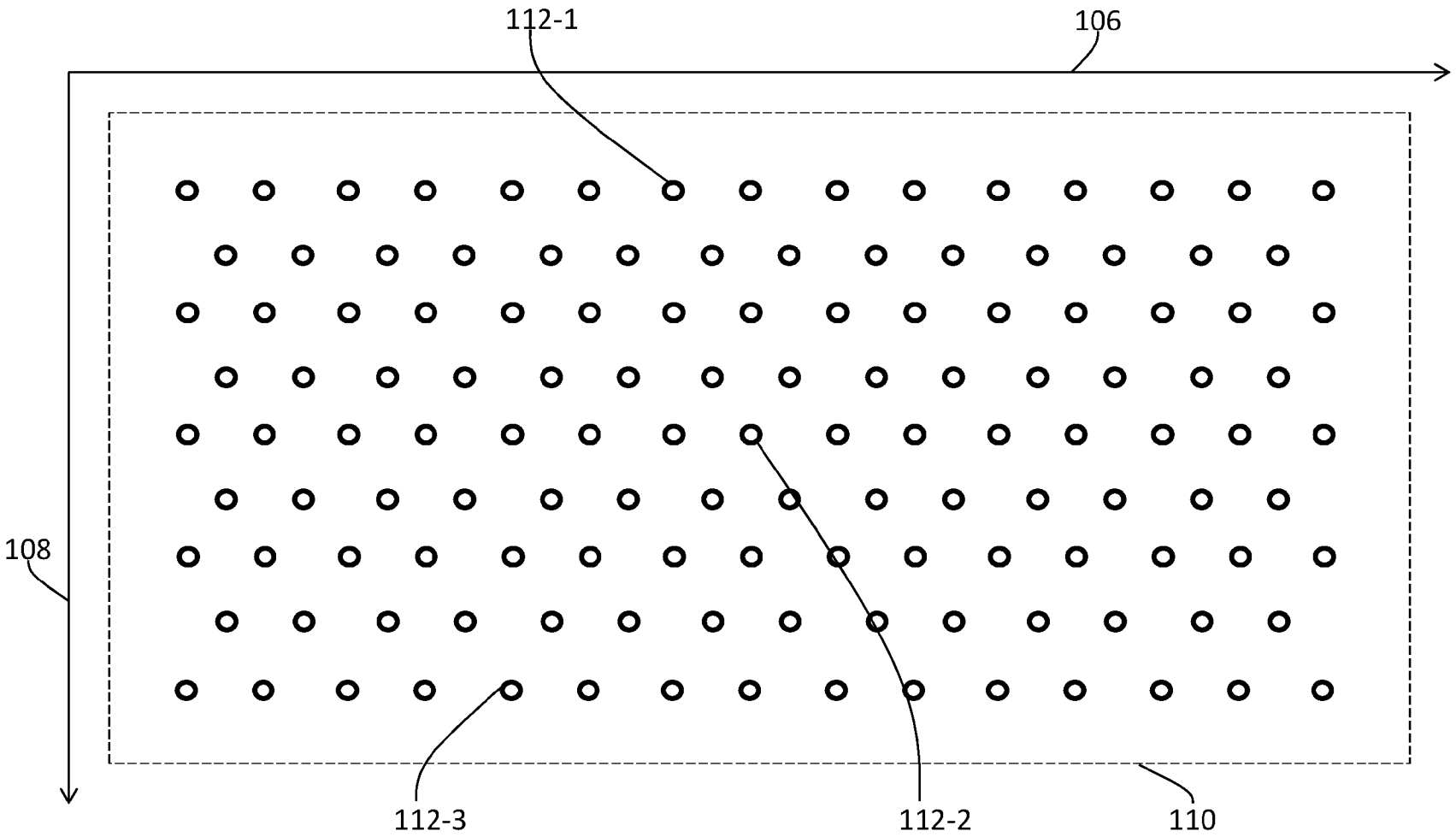
FIG. 1B illustrates an example spatial distribution 110 of light sources.
Figure 1C:
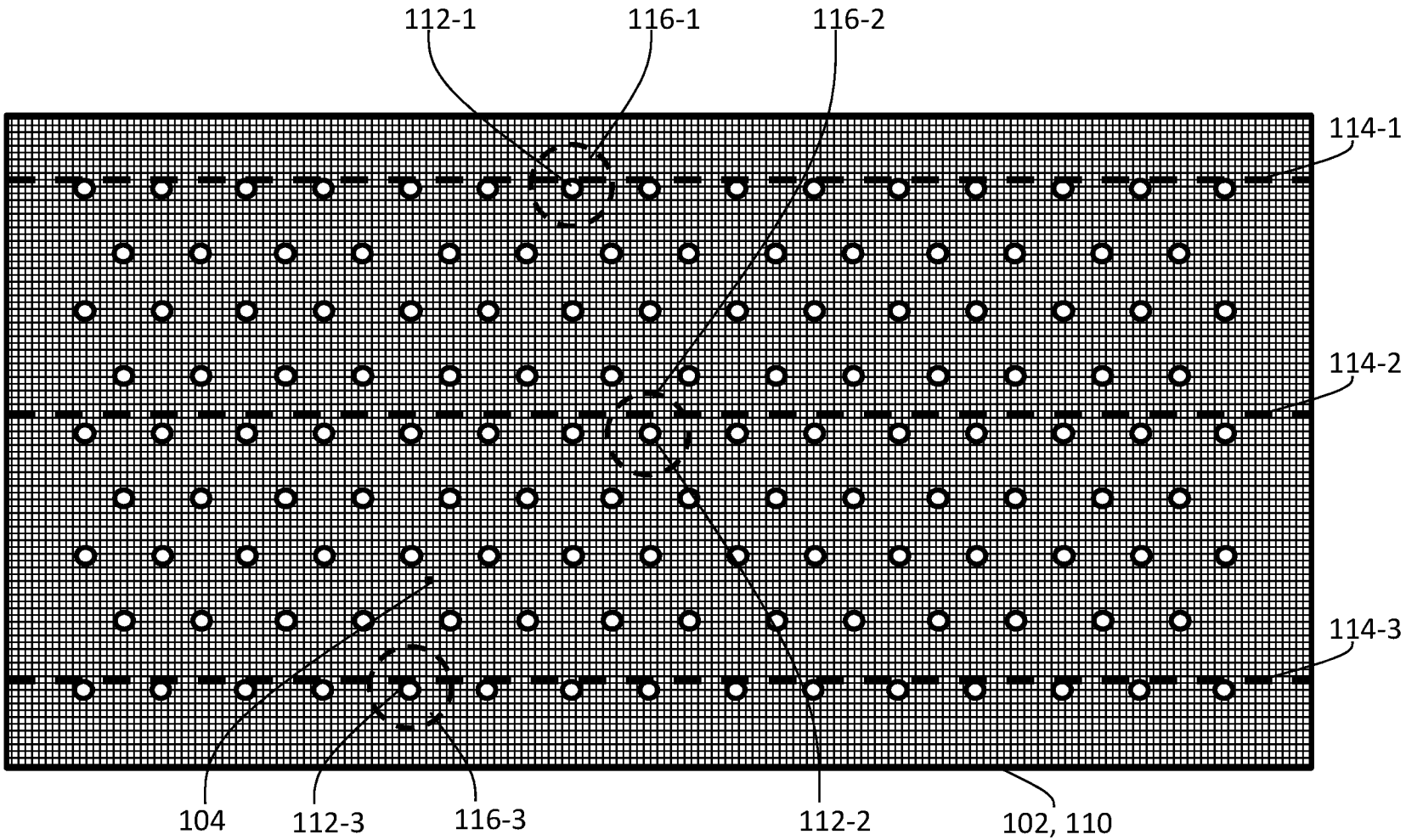
FIG. 1C illustrates an example spatial distribution of light sources disposed to illuminate pixels of a display panel.

FIG. 1C illustrates an example spatial distribution (e.g., 110, etc.) of light sources disposed to illuminate pixels of a display panel (e.g., 102, etc.). In some embodiments, the light sources (e.g., 112-1, 112-2, 112-3, etc.) may be of a similar or same type. Each of the light sources may be designated to illuminate pixels in a different region of the display panel (102). For example, a first light source 112-1 may be configured to illuminate pixels in a first region 116-1 of the display panel (102). A second light source 112-2 may be configured to illuminate pixels in a second region 116-2 of the display panel (102). A third light source 112-3 may be configured to illuminate pixels in a third region 116-3 of the display panel (102). A spatial distribution (e.g., how intensity varies spatially, etc.) of the illumination on the display panel (102) by light output of a light source may be represented by a point spread function (PSF).

A pixel value in image data of a frame to be rendered by the display panel (102) may be used to determine how much light should be transmitted through (or reflected from) a pixel (e.g., 104, etc.), or a subpixel therein, to a viewer. To express the pixel value correctly, the light to be transmitted through (or reflected from) the pixel or the subpixel therein must be accurately regulated according to the pixel value. Depending on the image data, a group of pixels in proximity on the display panel (102) that relate to a very luminous part of an image may require high illumination intensity, while a different group of pixels in proximity on the same display panel (102) that relate to a detailed indoor scene for the same image may require different illumination intensity. While transmissive and/or reflective properties of pixels (e.g., 104, etc.) or subpixels therein are set based on the image data, light output of the light sources may be controlled based at least in part on the image data so that different illumination intensities (or intensities of light output) can be provided to different parts of the display panel (102).

In some embodiments, the intensity of light output of a light source (e.g., 112-1, 112-2, 112-3, a light emitting diode or LED, etc.) as described herein is covariant with the amount of an electric current in the light source (e.g., over a p-n junction of an LED, etc.). The higher the amount of the electric current is, the more the light source emits photons. The amount of the electric current may be driven by a driving signal (e.g., a 6-bit digital driving signal, a 4-bit digital driving signal, a binary driving signal, a digital voltage signal, an analog voltage signal, etc.). The light source may be driven to different operational states in between the fully-off state and the fully-on state, by the driving signal set to different drive values (e.g., different digital drive values, different analog drive values, etc.) that respectively correspond to the different operational states.

A light source (e.g., 112-1, 112-2, 112-3, an LED, etc.) may be driven with one or more digital driving techniques, one or more analog driving techniques, or a combination of one or more digital driving techniques and one or more analog driving techniques. Examples of driving techniques include, but are not limited to only, any of: light source control pulse width modulation (PWM), light source control pulse code modulation (PCM), light source control pulse density modulation (PDM), etc.

In some embodiments, a light source (e.g., 112-1, 112-2, 112-3, an LED, etc.) may be driven by a PWM digital driving signal. A region in an image (or image data of a frame) may be rendered by an image processing system on a display panel (e.g., 102, etc.) within a frame time interval (depending on a display refresh rate) such as 1/60 second, 1/120 second, 1/300 second, etc. The frame time interval or a portion thereof may be divided into a number of PWM cycles such as twenty (20) PWM cycles, thirty (30) PWM cycles, forty (40) PWM cycles, fifty (50) PWM cycles, sixty (60) PWM cycles, etc. Each of the PWM cycles may have a cycle width that is a fraction of the frame time interval inversely proportional to the number of PWM cycles such as 1/20, 1/30, 1/40, 1/50, 1/60, etc., of the frame time interval. The PWM digital driving signal may comprise a plurality of PWM light source control pulses (e.g., non-zero drive values, non-dark-current values, etc.) each of which may be located within one of some or all of the PWM cycles. The (time-wise) width of a PWM light source control pulse located in a PWM cycle may be set to a (e.g., percentile, fractional, digital, variable, etc.) duty factor value, which represents a percentage of a cycle width of the PWM cycle. Some or all of the display refresh rate, the number of PWM cycles in the frame time interval and/or the number of PWM light source control pulses in the frame time interval may be set to sufficiently large so that the human perceptual system does not see flickers caused by intermittent light output generated by the light source driven by the PWM driving signal.

In some embodiments, a light source (e.g., 112-1, 112-2, 112-3, an LED, etc.) may be driven by a PCM digital driving signal. A frame time interval or a portion thereof may be divided into a number of PCM cycles such as twenty (20) PCM cycles, thirty (30) PCM cycles, forty (40) PCM cycles, fifty (50) PCM cycles, sixty (60) PCM cycles, etc. Each of the PCM cycles may have a cycle width that is a fraction of the frame time interval inversely proportional to the number of PCM cycles such as 1/20, 1/30, 1/40, 1/50, 1/60, a percentage value, etc., of the frame time interval. The PCM digital driving signal may comprise a plurality of PCM light source control pulses (e.g., non-zero drive values, non-dark-current values, etc.) each of which may be located within one of some or all of the PCM cycles. The height (e.g., magnitude, voltage, etc.) of a PCM light source control pulse located in a PCM cycle may be set to a (e.g., digital, variable, quantized, etc.) amplitude value. Some or all of the display refresh rate, the number of PCM cycles in the frame time interval and/or the number of PCM light source control pulses in the frame time interval may be set to sufficiently large so that the human perceptual system does not see flickers caused by intermittent light output generated by the light source driven by the PCM driving signal.

In some embodiments, a light source (e.g., 112-1, 112-2, 112-3, an LED, etc.) may be driven by a PDM digital driving signal. A frame time interval or a portion thereof may be divided into a variable number of PDM cycles. The PDM digital driving signal may comprise an equal number of constant magnitude PDM light source control pulses (e.g., non-zero drive values, non-dark-current values, etc.) each of which is located within a corresponding PDM cycle in the PDM cycles. Some or all of the display refresh rate and/or the variable number of PDM cycles in the frame time interval may be set to sufficiently large so that the human perceptual system does not see flickers caused by intermittent light output generated by the light source driven by the PDM driving signal.

Additionally, optionally, or alternatively, a light source (e.g., 112-1, 112-2, 112-3, an LED, etc.) may be driven by a light source driving signal that implements one or more PWM driving techniques alone, one or more PCM driving techniques alone, one or more PDM driving techniques alone, or a combination of the foregoing driving techniques.

In some embodiments, an intensity image is established by an image processing system based at least in part on an image (or image data of frame) to be rendered by the image processing system. In some embodiments, an intensity image is first generated using (e.g., per-pixel) maximum luminance values in pixels or subpixels thereof (e.g., red, green, or blue subpixels, etc.) in the image. The first intensity image may then be downsampled to generate one or more working resolution intensity images. A working resolution intensity image may have a spatial resolution lower than that of the initial intensity image. A pixel in the working resolution intensity image may correspond to a region (comprising multiple pixels) of the initial intensity image.

In some embodiments, a working resolution intensity image generated from the initial intensity image may comprise maximum luminance values by using a (e.g., moving) maximum luminance filter that selects the maximum of maximum luminance values of pixels, from the initial intensity image, in a spatial kernel (or a region of the initial intensity image) of the maximum luminance filter. Additionally, optionally, or alternatively, a working resolution intensity image generated from the initial intensity image may comprise mean luminance values by using a (e.g., moving) mean luminance filter that selects the mean value of maximum luminance values of pixels, from the initial intensity image, in a spatial kernel (or a region of the initial intensity image) of the mean luminance filter.

In some embodiments, the working resolution intensity images generated from the initial intensity image may be further combined, filtered and downsampled to a light source control image of a spatial resolution corresponding to (e.g., equal to, identical to, etc.) a spatial resolution of a spatial distribution (e.g., 110) of the light sources as illustrated in FIG. 1B. Additionally, optionally, or alternatively, the light source control image may be temporally filtered or smoothened to avoid temporal instabilities. The light source control image comprises a plurality of light source control values each of which provides a digital drive value used to drive a respective light source in the spatial distribution of the light sources.

The image processing system may generate a light field simulation that predicts a light field projected (or illuminated) by the light sources onto the pixels (e.g., 104, etc.) in the display panel (102). Light output of the light sources can be predicted based on the light source control image or digital drive values therein that are used to drive the light sources, and can then be combined or convolved with point spread functions of the light sources to generate the light field simulation.

The light field simulation can be set or upsampled to the same spatial resolution as per-pixel (or per-subpixel) spatial resolution of the image data of the frame to be rendered on the display panel (102). The image data of the frame and the light field simulation may be used to generate (e.g., by a division operation in a linear domain, by a subtraction operation in a logarithmic domain, etc.) a light valve control image of the same per-pixel (per-subpixel) spatial resolution of the frame to be rendered on the display panel (102). Whereas digital drive values in the light source control image are used to control the light sources in rendering the image, codewords in the light valve control image may be used to set light output regulation properties (e.g., light transmittances, light reflectances, etc.) of the light valves in the display panel (102). As used herein, codewords (of the light valve control image) for a specific region (e.g., 116-1, etc.) of the display panel (102) may be collectively referred to as a light valve control value for the specific region (116-1).

3. Image Data of Frames

Figure 2:
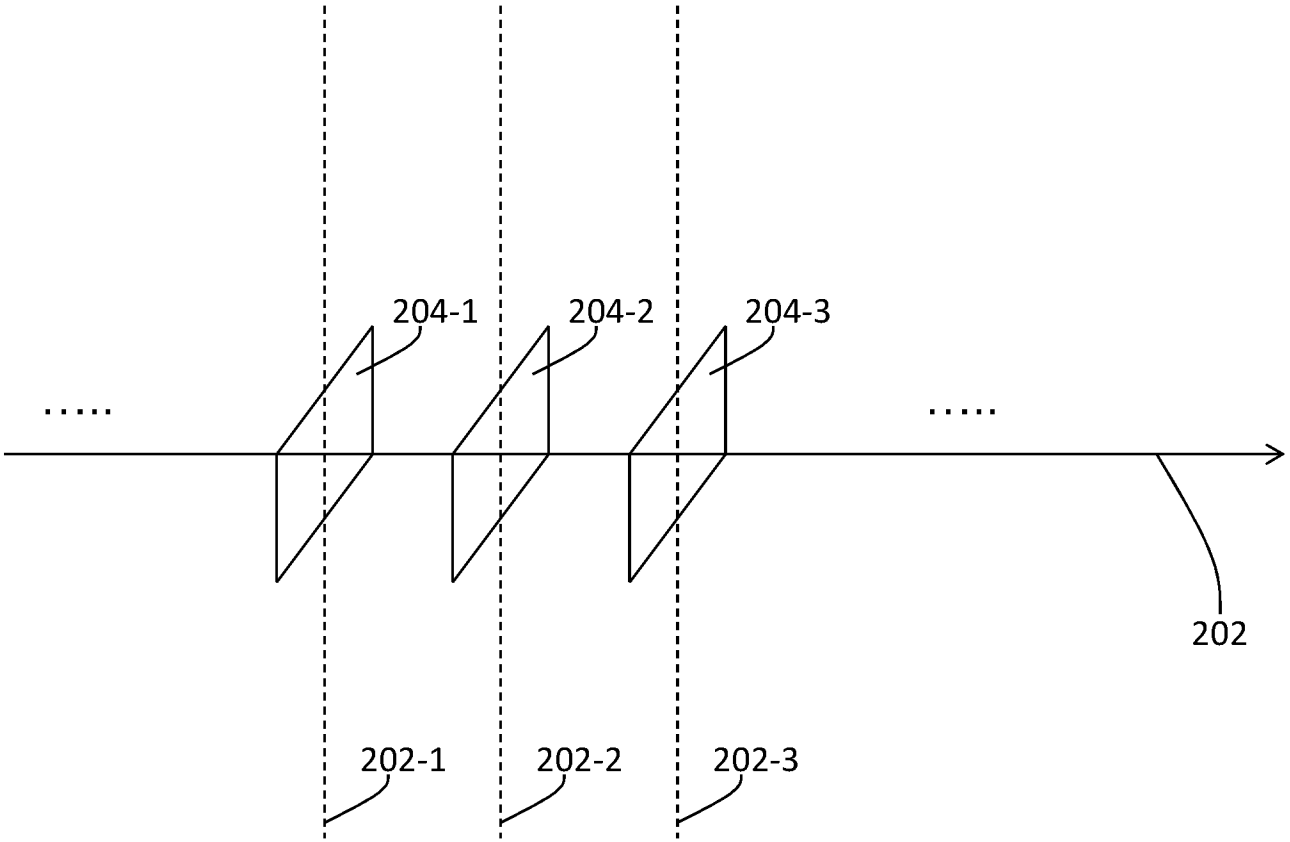
FIG. 2 illustrates an example sequence of images.

FIG. 2 illustrates an example sequence of images. Each image in the sequence of images may comprise image data of a frame (e.g., 204-1, 204-2, 204-3, etc.). The image data of the frame may be rendered starting at a frame time (e.g., 202-1, 202-2, 202-3, etc.) along a time direction 202. As used herein, the term "frame time" may refer to a time point in a sequence of time points starting at which images in the sequence of images are rendered.

To render image data of a frame (e.g., 204-2), codewords are generated based on the image data. The codewords can be used to set specific light output regulation properties (e.g., light transmittances, light reflectances, etc.) in (light valves of) pixels (e.g., 104) or subpixels of a display panel (e.g., 102). For example, the codewords may be loaded into registers used to control and set voltage values across electrodes (e.g., common electrodes, pixel electrodes, subpixel electrodes, etc.) in the pixels or the subpixels. The voltage values as set by the codewords in the registers across the electrodes in the pixels or subpixels can generate electric fields in the pixels or subpixels. Acted by the electric fields, light regulation materials in the pixels make physical state changes (e.g., optical state changes, rotate or orient optical axes, etc.) that result in the specific light output regulation properties (e.g., light transmittances, light reflectances, etc.) in the pixels or the subpixels.

In some embodiments, as illustrated in FIG. 1A and FIG. 1B, the pixels of the display panel (102) are divided into a plurality of scan lines (e.g., 114-1, 114-2, 114-3, etc.) arrayed in a first spatial direction such as the vertical direction (108 of FIG. 1A) of the display panel (102). Each (e.g., 114-1, etc.) of the scanlines comprises a plurality of pixels arrayed in a second spatial direction such as the horizontal direction (106 of FIG. 1A) of the display panel (102).

In some embodiments, an image processing system (e.g., a display device, a set-top device, a cloud-based server, etc.) may start scanning or driving the codewords as derived based on the image data of the frame into the pixels of the display panel (102) one scanline at a time. For example, to render the image data of the frame (204-2 in the present example), the image processing system may start scanning or driving the top scanline of the display panel (102) at the frame time (202-2); start scanning or driving the scanline immediately following the top scanline at the frame time (202-2) plus a scanline scanning offset time interval; start scanning or driving the next scanline at the frame time (202-2) plus two times the scanline scanning offset time interval; and so on.

In some embodiments, an image processing system (e.g., a display device, a set-top device, a cloud-based server, etc.) may start scanning or driving the codewords as derived based on the image data of the frame into the pixels of the display panel (102) more than one scanline at a time. For example, to render the image data of the frame (204-2 in the present example), the image processing system may start scanning or driving the top three scanlines of the display panel (102) at the frame time (202-2); start scanning or driving the next three scanlines immediately following the top three scanline at the frame time (202-1) plus a scanline scanning offset time interval; start scanning or driving the subsequent three scanline at the frame time (202-1) plus two times the scanline scanning offset time interval; and so on.

It should be noted that in various embodiments, different scanning methods and/or different scanning orders other than sequential scanning can be used in driving codewords into pixels or subpixels of a display panel (e.g., 102, etc.) for the purpose of setting specific light output regulation properties (e.g., light transmittances, light reflectances, etc.) in the pixels or the subpixels of the display panel (102). Furthermore, codewords may be (e.g., sequentially, etc.) loaded into different pixels of the same scanline at different starting times.

Techniques as described herein support light valves that are based on one or more of a wide variety of display technologies. A light valve may be implemented with one or more of LCD materials, phosphorus materials, quantum dot materials, etc.

4. Light Output Regulation Property

Figure 3:
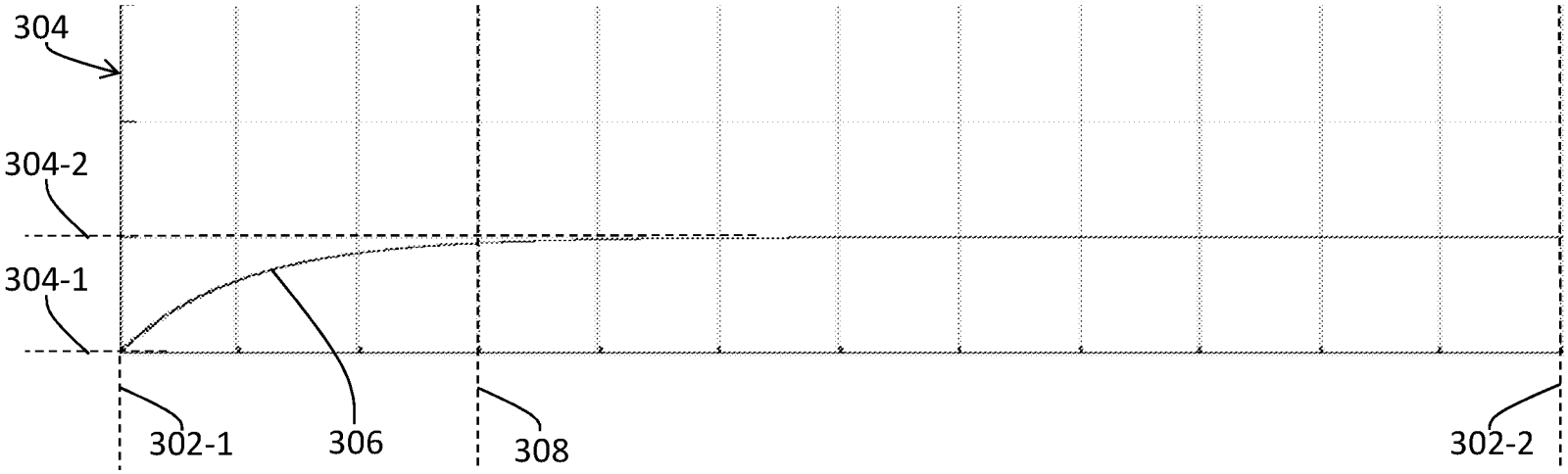
FIG. 3 illustrates an example plot of the light output regulation property of a specific region.

FIG. 3 illustrates an example plot 306 of the light output regulation property of a specific region (e.g., 116-1 of FIG. 1C, etc.) of a display panel (e.g., 102 of FIG. 1A or FIG. 1C, etc.) transitioning from a first light output regulation property value 304-1 to a second light output regulation property value 304-2 in a frame time interval for rendering an image. The horizontal axis in FIG. 3 represents values (or time points) of time. The vertical axis 304 in FIG. 3 represents values of the light output regulation property. Up to a start time 302-1, one or more light valves in the specific region (116-1) may be driven by one or more first codewords (e.g., collectively referred to a first light valve control value, etc.). The one or more first codewords cause the light output regulation property of the specific region (116-1) to reach the first light output regulation property (304-1) as a steady state value. After the start time (302-1) and up to an end time 302-2, the one or more light valves in the specific region (116-1) may be driven by one or more second codewords (e.g., collectively referred to a second light valve control value, etc.). The one or more second codewords cause the light output regulation property of the specific region (116-1) to reach the second light output regulation property value (304-2) as a steady state value.

The light output regulation property of the specific region (116-1) of the display panel (102) may be determined based on individual light output regulation properties of light valves in pixels or subpixels located in the specific region (116-1). For example, a value of the light output regulation property of the specific region (116-1) of the display panel (102) at any given time t may be computed as a mean, an average, a weight-based average, etc., of values of the individual light output regulation properties of the light valves in the pixels or the subpixels located in the specific region (116-1) at the time t.

For the purpose of illustration only, the display panel (102) is to render a region of the image as represented by the image data of the second frame (204-2) in the frame time interval starting from a start time 302-1 as represented by the second frame time (202-2) and ending at an end time 302-2 as represented by the third frame time (202-3) in FIG. 2. It should be noted that in some embodiments, a region of a black frame may be inserted in between two corresponding regions (both of which are to be rendered on the same region of the display panel (102)) of two images such as between the second frame 204-1 and the third frame 204-2 in FIG. 2, between the second frame 204-2 and the third frame 204-3 in FIG. 2, etc. In these embodiments, the start time (302-1) and/or the end time (302-2) may or may not coincide with frame time(s).

Prior to the starting time (302-1), first codewords as determined based at least in part on image data of a previous image (or the image data of the first frame (204-1) in the present example) were loaded into (e.g., registers of, switch elements of, etc.) the pixels or subpixels in the specific region (116-1) of the display panel (102) to set the individual light output regulation properties of the light valves of the pixel or the subpixel in such a way that the light output regulation property of the specific region (116-1) of the display panel (102) reaches the first light output regulation property value (304-1) in a steady state. As used herein, the first codewords loaded into the light valves of the specific region (116-1) may be collectively referred to as a first light valve control value for the specific region (116-1).

After the starting time (302-1), second codewords as determined based on the image (or the image data of the second frame (204-2) in the present example) are loaded into (e.g., the register of, the switch element of, etc.) the pixels or subpixels in the specific region (116-1) of the display panel (102) to set the individual light output regulation properties of the light valves of the pixel or the subpixel in such a way that the light output regulation property of the specific region (116-1) of the display panel (102) is transitioned from the first light output regulation property value (304-1) to the second light output regulation property value (304-2) in a new steady state. As used herein, the second codewords loaded into the light valves of the specific region (116-1) may be collectively referred to as a second light valve control value for the specific region (116-1).

The light output regulation property of the light valves in the specific region (116-1) of the display panel (102) may not be changed instantaneously from a first value (e.g., 304-1, etc.) to a second value (e.g., 304-2, etc.). For example, in embodiments in which the light valves are LCD cells, new individual electric fields each of which corresponds to a respective second codeword in the second codewords may be generated in the pixels or the subpixels after the second codewords are loaded into the pixels or the subpixels. Acted by the new electric fields, LCD materials in the LCD cells of the light valves may undergo physical state changes such as orientation changes (e.g., rotate or re-orient optical axes, etc.) of liquid crystal materials, etc., in order to transition the LCD materials in the LCD cells of the light valves into steady states that collectively correspond to the second light output regulation property value (304-2). The physical state changes in the light valves in the specific region (116-1) of the display panel (102) for the purpose of transitioning from the first light output regulation property value (304-1) to the second light output regulation property value (304-2) may collectively take a fraction of the frame time interval. The fraction of the frame time interval may start at the start time (302-1) and end at a settling time 308 before the end time (302-2). At the settling time (308), the light valves may have (e.g., approximately, no less than 90%, etc.) completed the transition from the first light output regulation property value (304-1) to the second light output regulation property value (304-2).

5. Light Source Control Waveforms

Figure 4A:
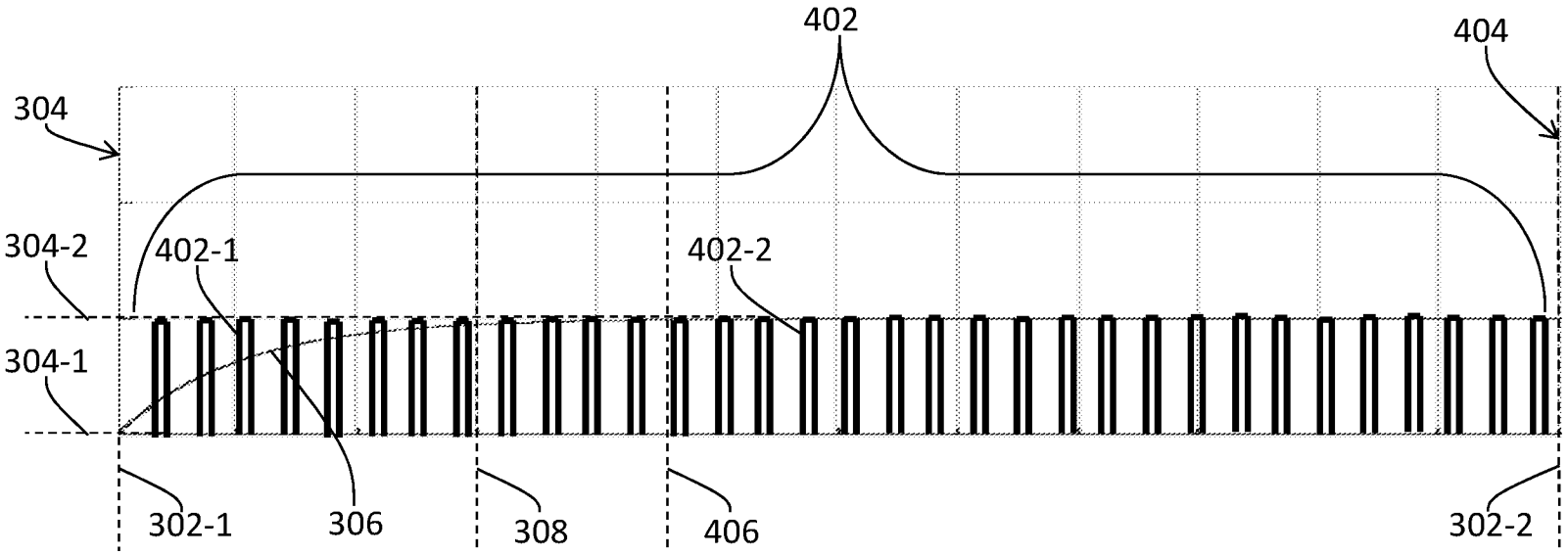
FIG. 4A through FIG. 4K illustrate example light source driving waveforms.

FIG. 4A illustrates an example light source driving waveform comprising a sequence 402 of light source control pulses used by a system as described herein to drive a light source (e.g., 112-1 of FIG. 1C, etc.) that is designated to illuminate (e.g., backlight, etc.) light valves in a specific region (e.g., 116-1 of FIG. 1C, etc.) of a display panel (e.g., 102 of FIG. 1A or FIG. 1C, etc.), with an example plot (e.g., 306 of FIG. 3, etc.) of the light output regulation property of the specific region (116-1) of the display panel (102) transitioning from a first light output regulation property value (e.g., 304-1 of FIG. 3, etc.) to a second light output regulation property value (e.g., 304-2 of FIG. 3, etc.) in a frame time interval for rendering an image (e.g., the image data of the second frame (204-2), etc.). The horizontal axis in FIG. 4A represents values of time. The vertical axes 304 and 404 in FIG. 4A respectively represent values of the light output regulation property and energies of light source control pulses in the sequence (402) of light source control pulses.

In some embodiments, the sequence (402) of light source control pulses spans across the frame time interval including light source control pulses (e.g., 402-1, 402-2, etc.) with non-zero amplitudes within (e.g., as indicated by the light source control pulse (402-1), etc.) and without (e.g., as indicated by the light source control pulse (402-2), etc.) the fraction of the frame time interval between the start time (302-1) and the settling time (308).

As the light valves in the specific region (116-1) of the display panel (102) are still in processes of settling into their individual steady states, the light valves have transitory light output regulation property values varying from the first light output regulation property value (304-1) to the second light output regulation property value (304-2). The light source control pulses (e.g., 402-1, etc.) in the sequence (402) of light source control pulses within the fraction of the frame time interval produce a fraction of the total light output of the light source (112-1) proportional to the fraction of the frame time interval. This fraction of the total light output within the fraction of the frame time interval is then regulated by the light valves with the transitory light output regulation property values. Because the light valves have transitory light output regulation property values within the fraction of the frame time interval, contribution to the rendering of the image from the regulated light from the light valves of the specific region (116-1) of the display panel (102) within the fraction of the frame time interval may be incorrect in terms of proportional brightness levels of the pixels or the subpixels that correspond to the light valves within the fraction of the frame time interval, depending on how large the difference between the first light output regulation property value (which is a steady state value corresponding to the first light valve control value) and the second light output regulation property value (which is a new steady state value corresponding to the second light valve control value) in the specific region of the image is. In some embodiments, the fraction of the frame time interval in which the light valves have transitory light output regulation property values may be sufficient large to cause visual artifacts (e.g., blurs, jitters, etc.) especially if the image belongs to one of a group of images that depict objects or characters in motion such that the difference between the first light valve control value (which produces the first light output regulation property value in the steady state) and the second light valve control value (which produces the second light output regulation property value reached in the new steady state) in the specific region of the image exceeds a light valve control threshold.

Techniques as described herein can be used by an image processing system, a set-top device, a display device, a television, etc., to generate any of a variety of light driving waveforms to control timings and intensities of light output of light sources for the purpose of avoiding or reducing visual artifacts in images that may comprise regions with large changes in light output regulation properties.

Figure 4B:
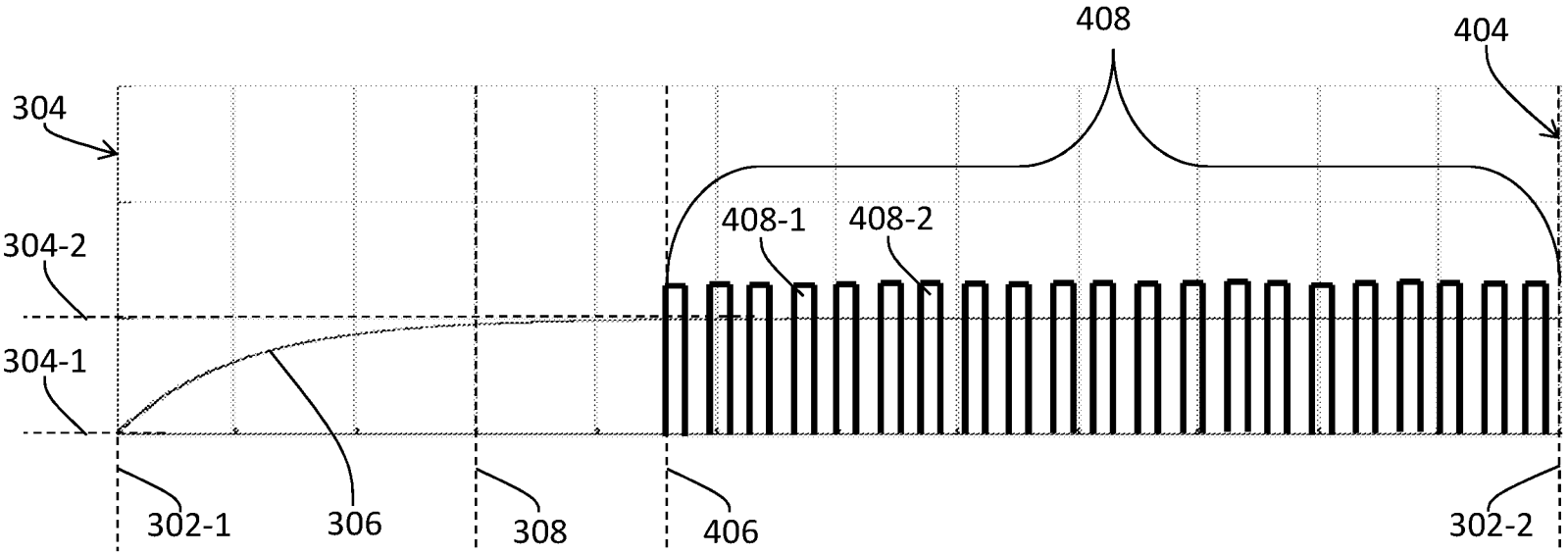

FIG. 4B illustrates an example light source driving waveform comprising a sequence 408 of light source control pulses used by a system as described herein to drive a light source (e.g., 112-1 of FIG. 1C, etc.) that is designated to illuminate (e.g., backlight, etc.) light valves in a specific region (e.g., 116-1 of FIG. 1C, etc.) of a display panel (e.g., 102 of FIG. 1A or FIG. 1C, etc.), with an example plot (e.g., 306 of FIG. 3, etc.) of the light output regulation property of the specific region (116-1) of the display panel (102) transitioning from a first light output regulation property value (e.g., 304-1 of FIG. 3, etc.) to a second light output regulation property value (e.g., 304-2 of FIG. 3, etc.) in a frame time interval for rendering an image (e.g., the image data of the second frame (204-2), etc.). The horizontal axis in FIG. 4B represents values of time. The vertical axes 304 and 404 in FIG. 4B respectively represent values of the light output regulation property and energies of light source control pulses in the sequence (408) of light source control pulses.

In some embodiments, the sequence (408) of light source control pulses does not span across the frame time interval including light source control pulses with non-zero amplitudes within and without the fraction of the frame time interval between the start time (302-1) and the settling time (308). Rather, the sequence (408) of light source control pulses only comprises light source control pulses (e.g., 408-1, 408-2, etc.) with non-zero amplitudes after a light source control pulse start time 406. In some embodiments, the light source control pulse start time (406) is after the settling time (308).

The light source control pulses (e.g., 408-1, 408-2, etc.) in the sequence (408) of light source control pulses between the light source control pulse start time (406) and the end time (302-2) generate the total light output of the light source (112-1) according to a light control codeword in a light source control image for the light source (112-1). Because the light valves have (e.g., entirely, asymptotically, substantially, etc.) settled into the second light output regulation property value (304-2) after the light source control pulse start time (406), the regulated light from the light valves of the specific region (116-1) of the display panel (102) is visually correct in terms of brightness levels of the pixels or the subpixels that correspond to pixel values in the image (or the image data of the second frame (304-2)). As a result, visual artifacts (e.g., blurs, jitters, etc.), which may be produced by the sequence (402) of light source control pulses in FIG. 4A, can be avoided by the sequence (408) of light source control pulses in FIG. 4B, even if the image belongs to one of a group of images that depict objects or characters in motion.

In some embodiments, to maintain the same total light output as produced by the sequence (402) of light source control pulses in FIG. 4A, energies of the light source control pulses (e.g., 408-1, 408-2, etc.) in the sequence (408) of light source control pulses in FIG. 4B may be increased to compensate for the loss of light output between the start time (302-1) and the light source control pulse start time (406).

For example, if the sequence (408) of light source control pulses represents a sequence of PWM light source control pulses, individual duty factors in individual PWM light source control pulses in the sequence of PWM light source control pulses can be adjusted to compensate for the loss of light output between the start time (302-1) and the light source control pulse start time (406). If the sequence (408)

of light source control pulses represents a sequence of PCM light source control pulses, individual amplitudes in individual PCM light source control pulses in the sequence of PCM light source control pulses can be adjusted to compensate for the loss of light output between the start time (302-1) and the light source control pulse start time (406). If the sequence (408) of light source control pulses represents a sequence of PDM light source control pulses, a modulated frequency of PDM light source control pulses in the sequence of PDM light source control pulses can be adjusted to compensate for the loss of light output between the start time (302-1) and the light source control pulse start time (406).

Figure 4C:
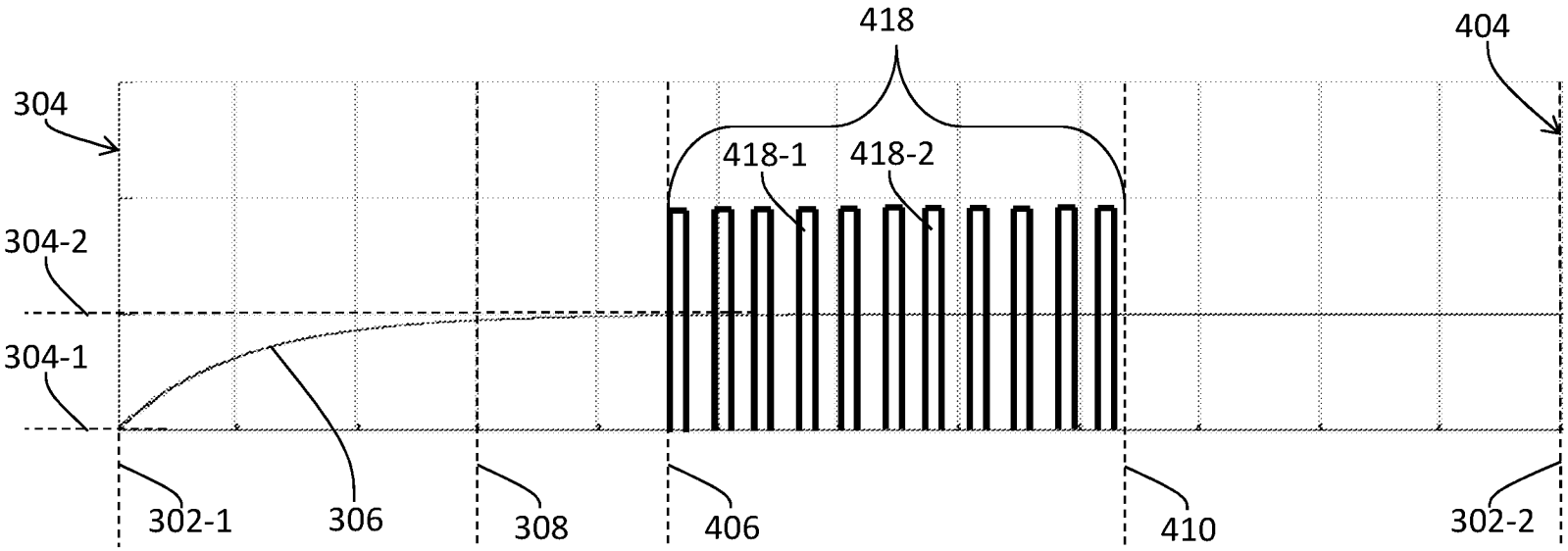

FIG. 4C illustrates an example light source driving waveform comprising a sequence 418 of light source control pulses used by a system as described herein to drive a light source (e.g., 112-1 of FIG. 1C, etc.) that is designated to illuminate (e.g., backlight, etc.) light valves in a specific region (e.g., 116-1 of FIG. 1C, etc.) of a display panel (e.g., 102 of FIG. 1A or FIG. 1C, etc.). In some embodiments, the sequence (418) of light source control pulses only comprises light source control pulses (e.g., 418-1, 418-2, etc.) with non-zero amplitudes after the light source control pulse start time (406). In some embodiments, the light source control pulses (e.g., 418-1, 418-2, etc.) in the sequence (418) of light source control pulses span over a time interval from the light source control pulse start time (406) after the settling time (308) to a light source control pulse end time 410 before the end time (302-2).

The light source control pulses (e.g., 418-1, 418-2, etc.) in the sequence (418) of light source control pulses between the light source control pulse start time (406) and the end time (302-2) drive the light source (112-1) to generate the total light output of the light source (112-1) according to a light control codeword in a light source control image for the light source (112-1). Because the light valves have (e.g., entirely, asymptotically, substantially, etc.) settled into the second light output regulation property value (304-2) after the light source control pulse start time (406), the regulated light from the light valves of the specific region (116-1) of the display panel (102) is visually correct in terms of brightness levels of the pixels or the subpixels that correspond to pixel values in the image (or the image data of the second frame (304-2)). As a result, visual artifacts (e.g., blurs, jitters, etc.), which may be produced by the sequence (402) of light source control pulses in FIG. 4A, can be avoided by the sequence (418) of light source control pulses in FIG. 4C, even if the image belongs to one of a group of images that depict objects or characters in motion.

In some embodiments, to maintain the same total light output as produced by the sequence (402) of light source control pulses in FIG. 4A, energies of the light source control pulses (e.g., 418-1, 418-2, etc.) in the sequence (418) of light source control pulses in FIG. 4C may be increased to compensate for the loss of light output between the start time (302-1) and the light source control pulse start time (406) and between the light source control pulse end time (410) and the end time (302-2).

In some embodiments, a sequence of light source control pulses as described herein may start as soon as the settling time (308) so that image data in the specific region of the image can be rendered as soon as possible to reduce the delay for a viewer to see the image. In some embodiments, a sequence of light source control pulses as described herein may start one of other times after the settling time (308). A light source control pulse start time (e.g., 406) as described herein may be a time point as one of a settling time (e.g., 308), a start time (e.g., 302-1) plus ¼ of a frame time interval (e.g., from the start time (302-1) to the end time (302-2), the start time (302-1) plus ⅓ of the frame time interval, the start time (302-1) plus ½ of the frame time interval, the start time (302-1) plus ⅔ of the frame time interval, the start time (302-1) plus ¾ of the frame time interval, etc.

A light source control pulse end time (e.g., 410) as described herein may be one of various time points after the light source control pulse start time (406) and before the end time (302-2).

In some embodiments, a sequence of light source control pulses as described herein may have a temporal average position so that image data in the specific region of the image can be rendered perceptually synchronous with other regions of the image. The temporal average position of the sequence of light source control pulses can be derived based on averaging individual time points of individual light source control pulses in the sequence of light source control pulses with non-zero amplitudes using energies of the individual time points as weight factors. A temporal average position (e.g., derived based on averaging individual time points of light source control pulses with non-zero amplitudes, etc.) of a sequence of light source control pulses as described herein may be (e.g., constrained to be, etc.) a time point as one of a time point after a settling time (e.g., 308), a start time (e.g., 302-1) plus ¼ a of a frame time interval (e.g., from the start time (302-1) to the end time (302-2), the start time (302-1) plus ⅓ of the frame time interval, the start time (302-1) plus ½ of the frame time interval, the start time (302-1) plus ⅔ of the frame time interval, the start time (302-1) plus ¾ of the frame time interval, etc.

In an example implementation, a sequence of light source control pulses (e.g., the sequence (418), etc.), which is used to drive illumination of a light source (e.g., 112-1 of FIG. 1C, etc.), can be "centered" at a fixed time point (e.g., as represented by the temporal average position of the sequence of light source control pulses, etc.) in the period between 302-1 and 302-2. For example, the sequence (418) may, but is not limited to only, be centered at a fixed temporal position of the frame time interval such as ½ of the frame time interval. The light source control pulse start time (406) and end time (410) of the sequence (418) may move oppositely and equally from the fixed temporal position (½ of the frame time interval in the present example) to maintain the centering of the sequence (418) at the fixed temporal position from light source to light source, from frame to frame, etc.

Figure 4D:
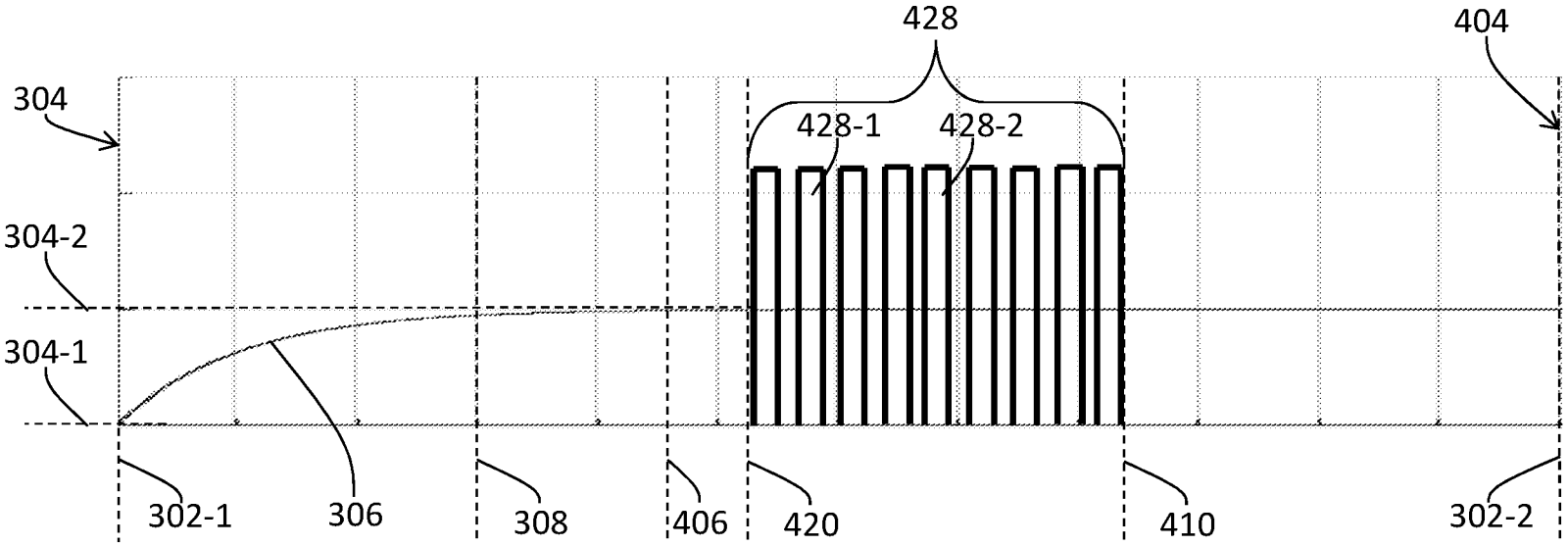
Figure 4E:
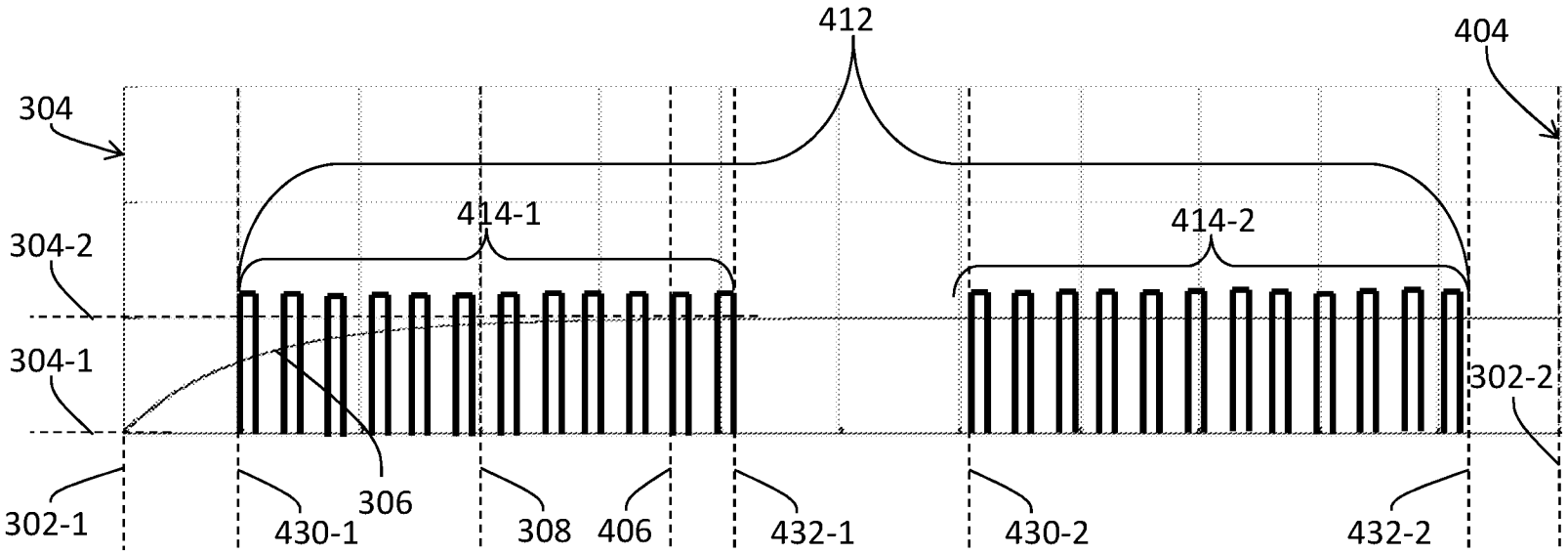
Figure 4F:
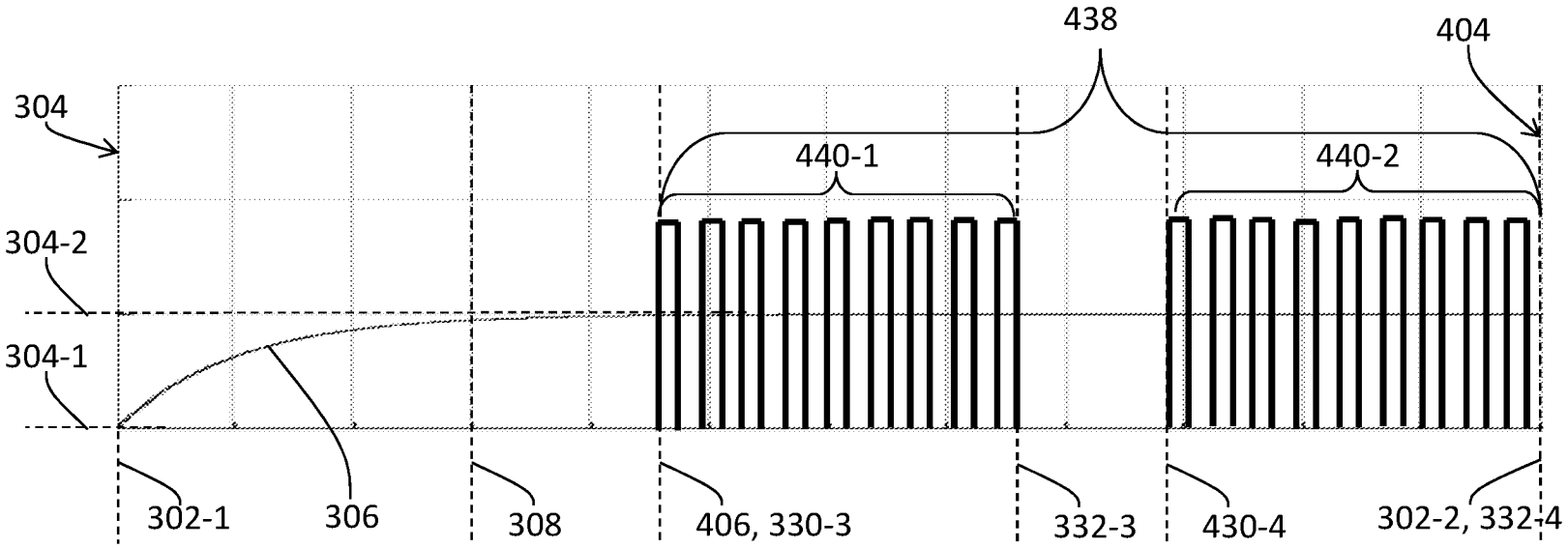
Figure 4G:
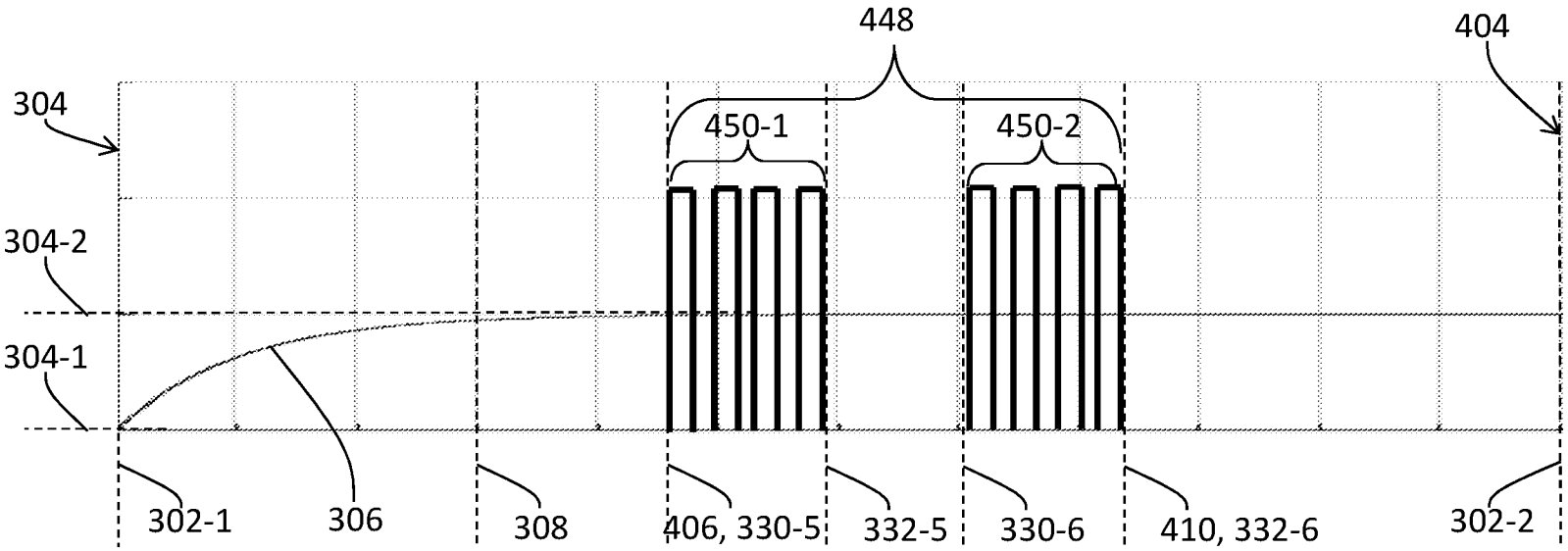
Figure 4H:
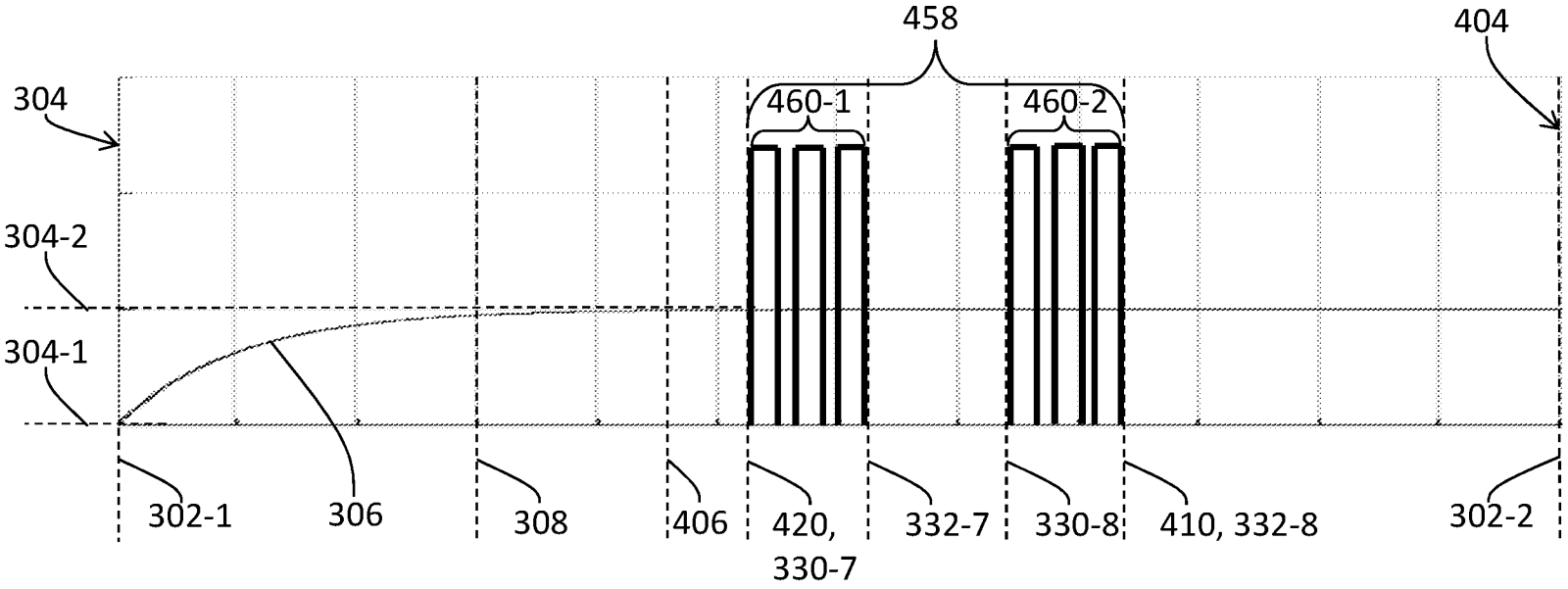
Figure 4I:
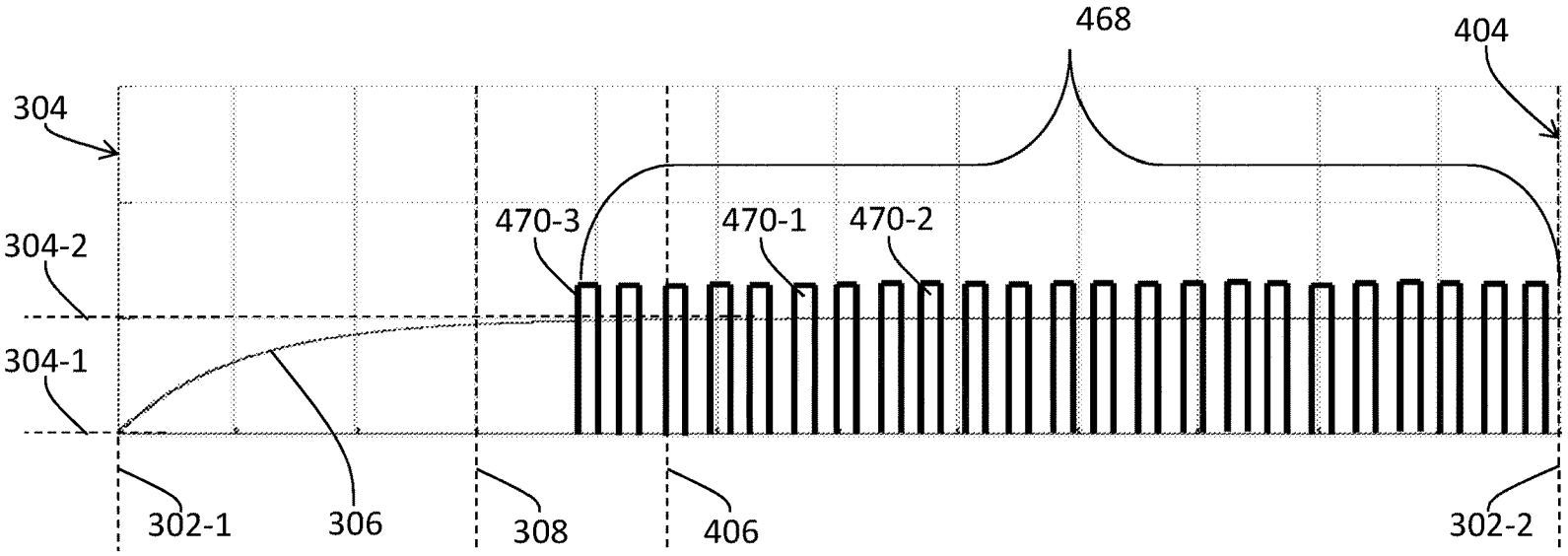
Figure 4J:
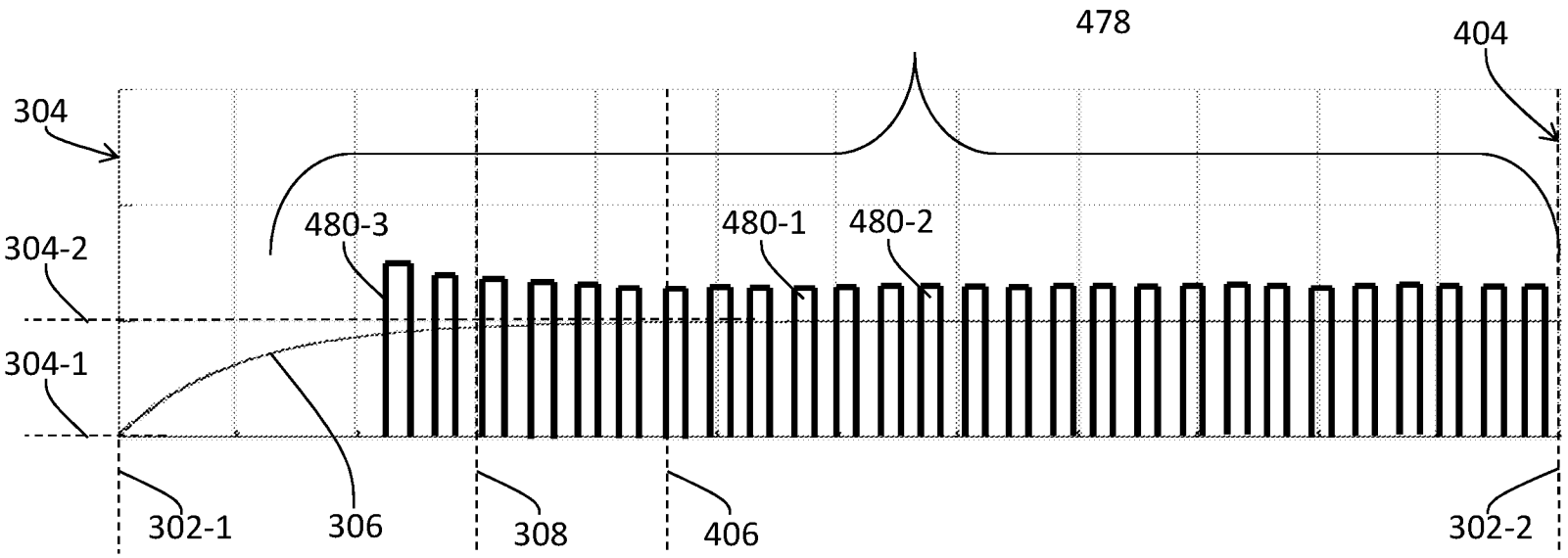
Figure 4K:
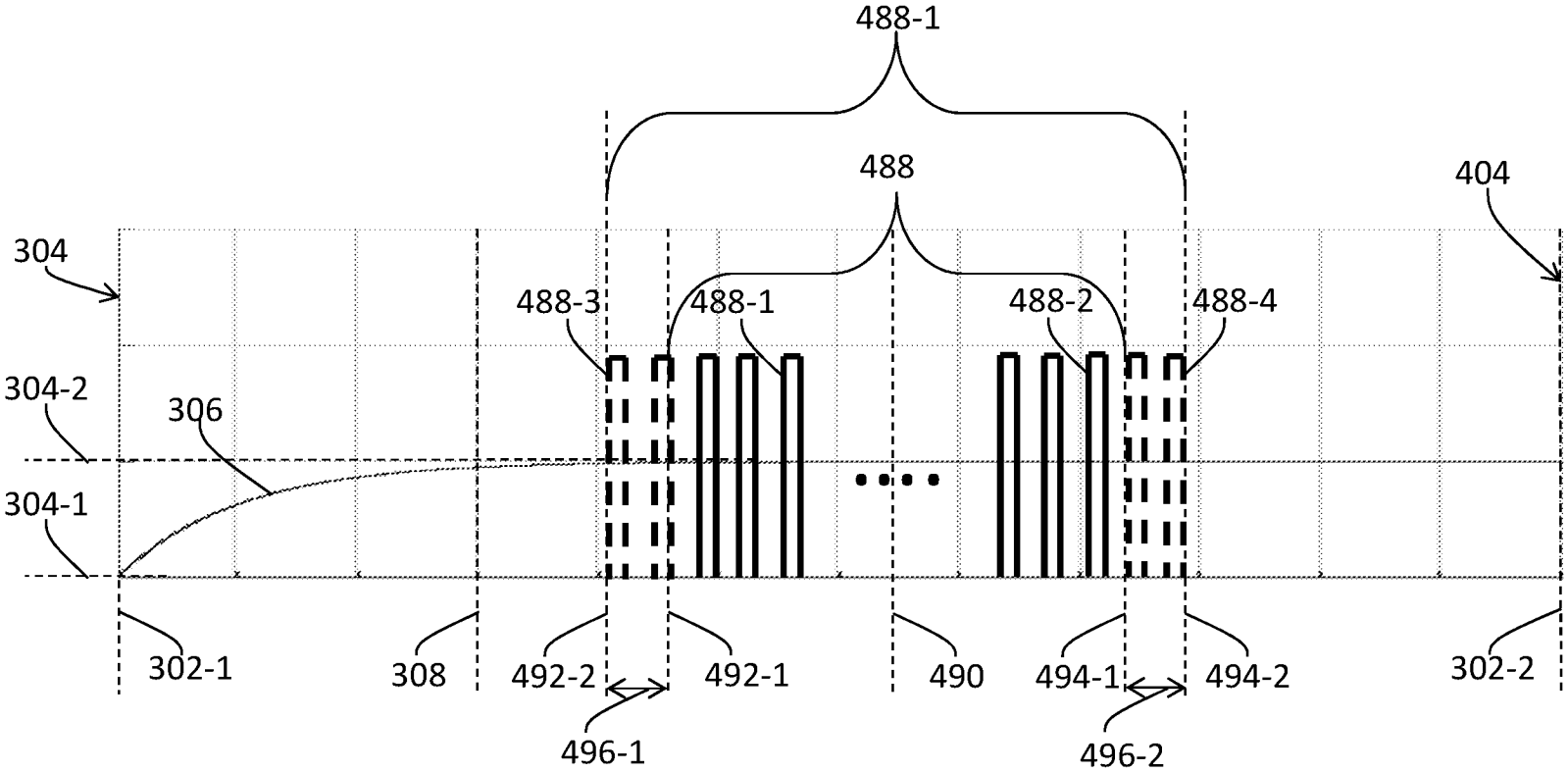

FIG. 4K illustrates two example sequences 488 and 488-1 of light source control pulses. The sequence (488) starts at a first pulse start time (492-1), ends at a first pulse end time (494-1), and has a temporal average position that is constrained to be a fixed time point 490 between the start time (302-1) and the end time (302-2). The sequence (488-1) starts at a second pulse start time (492-2), ends at a second pulse end time (494-2), and has a temporal average position that is also constrained to be the fixed time point (490) between the start time (302-1) and the end time (302-2). As illustrated in FIG. 4K, the sequence (488-1) can be constructed from the sequence (488) by moving the first pulse start time (492-1) to the second pulse start time (492-2) in the left direction by a start time interval increment 496-1, and by moving the first pulse end time (494-1) to the second pulse end time (494-2) oppositely and equally in the right direction by an end time interval increment 496-2, where the start time interval increment (496-1) equals the end time interval increment (496-2). As a result, the sequence (488-1)

thus constructed from the sequence (488) maintains the temporal average position at the fixed time position (490).

In some embodiments, temporal average positions of multiple sequences (e.g., 488, 488-1, etc.) of light source control pulses that are used to drive multiple light sources in the same frame are constrained to be a fixed time point at a fixed time interval (e.g., ½ of a frame time interval, etc.) after their respective start times (e.g., 302-1, etc.). For example, in some embodiments, the sequence (488) may be used to drive illumination of a first light source (e.g., 112-1 of FIG. 1C, etc.) on a first region (e.g., 116-1, etc.) of a display panel (e.g., 102, etc.) for rendering a specific frame, whereas the sequence (488-1) may be used to drive illumination of a second different light source (e.g., 112-2 of FIG. 1C, etc.) on a second different region (e.g., 116-2, etc.) of the display panel (102) for rendering the same specific frame. Here, the start time (302-1) and the end time (302-2) are relative times. The start time (302-1) and the end time (302-2) for driving the first light source (112-1) to illuminate the first region (116-1) of the display panel (102) define a first time period in which light valve control codewords/values are loaded in light valves of the first region (116-1) of the display panel (102) for the specific frame. The start time (302-1) and the end time (302-2) for driving the second light source (112-2) to illuminate the second region (116-2) of the display panel (102) for the same specific frame.

In some embodiments, temporal average positions of multiple sequences (e.g., 488, 488-1, etc.) of light source control pulses that are used to drive the same light source in different frames are constrained to be a fixed time point at a fixed time interval (e.g., ½ of a frame time interval, etc.) after their respective start times (e.g., 302-1, etc.). For example, in some embodiments, the sequence (488) may be used to drive illumination of a light source (e.g., 112-1 of FIG. 1C, etc.) on a region (e.g., 116-1, etc.) of a display panel (e.g., 102, etc.) for rendering a first frame, whereas the sequence (488-1) may be used to drive illumination of the same light source (112-1) on the same region (116-1) of the display panel (102) for rendering a second different frame (e.g., a frame preceding the first frame, a frame following the first frame, etc.). Here, the start time (302-1) and the end time (302-2) are relative times. The start time (302-1) and the end time (302-2) for driving the light source (112-1) to illuminate the region (116-1) of the display panel (102) for the first frame define a first time period in which light valve control codewords/values are loaded in light valves of the region (116-1) of the display panel (102) for the first frame. The start time (302-1) and the end time (302-2) for driving the light source (112-1) to illuminate the region (116-1) of the display panel (102) for the second frame define a second time period in which light valve control codewords/values are loaded in light valves of the region (116-1) of the display panel (102) for the second frame.

In some embodiments, a sequence of light source control pulses in a light source control waveform comprises a single cluster of light source control pulses. In some embodiments, a sequence of light source control pulses in a light source control waveform comprises two or more clusters of light source control pulses. Two neighboring clusters in the multiple clusters of light source control pulses are separated from each other by a relatively large time interval (e.g., much greater than (e.g., five times, ten times, etc.) a light source control pulse cycle time interval, etc.) as compared with a light source control pulse cycle time interval (e.g., 1/30 of the frame time interval, etc.) in which a light source control pulse is located. In some embodiments, the multiple clusters of light source control pulses can be used to multiple display refreshes in a frame time interval of rendering a single image (or frame).

FIG. 4E illustrates an example light source driving waveform comprising a sequence 412 of light source control pulses used by a system as described herein to drive a light source (e.g., 112-1 of FIG. 1C, etc.) that is designated to illuminate (e.g., backlight, etc.) light valves in a specific region (e.g., 116-1 of FIG. 1C, etc.) of a display panel (e.g., 102 of FIG. 1A or FIG. 1C, etc.). The horizontal axis in FIG. 4A represents values of time. The vertical axes 304 and 404 in FIG. 4A respectively represent values of the light output regulation property and energies of light source control pulses in the sequence (412) of light source control pulses.

In some embodiments, the sequence (412) of light source control pulses comprises a first cluster 414-1 of light source control pulses and a second cluster 414-2. The first cluster (414-1) starts at a first cluster start time 430-1 and ends at a first cluster end time 432-1. The second cluster (414-2) starts at a first cluster start time 430-2 and ends at a first cluster end time 432-2.

In some embodiments, the first cluster (414-1) comprises light source control pulses before the settling time (308). Thus, in operational scenarios in which the specific region (116-1) of the display panel (102) changes greatly in the light output regulation property, contribution to the rendering of the image from the regulated light from the light valves of the specific region (116-1) of the display panel (102) from the first cluster (414-1) of light source control pulses may be incorrect in terms of proportional brightness levels of the pixels or the subpixels that correspond to the light valves within a fraction of the frame time interval before the settling time (308). Visual artifacts (e.g., blurs, jitters, etc.) may occur especially if the image belongs to one of a group of images that depict objects or characters in motion such that the difference between the first light valve control value (which produces the first light output regulation property value in the steady state) and the second light valve control value (which produces the second light output regulation property value in the new steady state) in the specific region of the image exceeds a light valve control threshold.

FIG. 4F through FIG. 4H illustrate example light source driving waveforms each of which comprises a sequence (e.g., 438, 448, 458, etc.) of light source control pulses used by a system as described herein to drive a light source (e.g., 112-1 of FIG. 1C, etc.) that is designated to illuminate (e.g., backlight, etc.) light valves in a specific region (e.g., 116-1 of FIG. 1C, etc.) of a display panel (e.g., 102 of FIG. 1A or FIG. 1C, etc.). The horizontal axes in FIG. 4F through FIG. 4H represent values of time. The vertical axes 304 and 404 in FIG. 4F through FIG. 4H respectively represent values of the light output regulation property and energies of light source control pulses in the sequences (e.g., 438, 448, 458, etc.) of light source control pulses.

In some embodiments, the sequences (e.g., 438, 448, 458, etc.) of light source control pulses only comprise light source control pulses with non-zero amplitudes after the light source control pulse start time (406) after the settling time (308). The sequence (438) of light source control pulses in FIG. 4F comprises a first cluster 440-1 of light source control pulses and a second cluster 440-2. The first cluster (440-1) in the sequence (438) of light source control pulses in FIG. 4F starts at a third cluster start time 330-3 and ends at a third cluster end time 332-3. The second cluster (440-2) in the sequence (438) of light source control pulses in FIG.

4F starts at a fourth cluster start time 330-4 and ends at a fourth cluster end time 332-4.

The sequence (448) of light source control pulses in FIG. 4G comprises a first cluster 450-1 of light source control pulses and a second cluster 450-2. The first cluster (450-1) in the sequence (448) of light source control pulses in FIG. 4G starts at a fifth cluster start time 330-5 and ends at a fifth cluster end time 332-5. The second cluster (450-2) in the sequence (448) of light source control pulses in FIG. 4G starts at a sixth cluster start time 330-6 and ends at a sixth cluster end time 332-6.

The sequence (458) of light source control pulses in FIG. 4H comprises a first cluster 460-1 of light source control pulses and a second cluster 460-2. The first cluster (460-1) in the sequence (458) of light source control pulses in FIG. 4H starts at a seventh cluster start time 330-7 and ends at a seventh cluster end time 332-7. The second cluster (460-2) in the sequence (458) of light source control pulses in FIG. 4H starts at an eighth cluster start time 330-8 and ends at an eighth cluster end time 332-8.

The light source control pulses in each of the sequences (e.g., 438, 448, 458, etc.) of light source control pulses may be constructed specifically to generate the total light output of the light source (112-1) according to a light control codeword in a light source control image for the light source (112-1). Because the light valves have (e.g., entirely, asymptotically, substantially, etc.) settled into the second light output regulation property value (304-2) after the light source control pulse start time (406), the regulated light from the light valves of the specific region (116-1) of the display panel (102) is visually correct in terms of brightness levels of the pixels or the subpixels that correspond to pixel values in the image (or the image data of the second frame (304-2)). As a result, visual artifacts (e.g., blurs, jitters, etc.), which may be produced by the sequence (402) of light source control pulses in FIG. 4A or the sequence (412) of light source control pulses in FIG. 4E, can be avoided by the each of the sequences (e.g., 438, 448, 458, etc.) of light source control pulses in FIG. 4F through FIG. 4H, even if the image belongs to one of a group of images that depict objects or characters in motion.

In some embodiments, to maintain the same total light output as produced by the sequence (402) of light source control pulses in FIG. 4A or the sequence (412) of light source control pulses in FIG. 4E, energies of the light source control pulses (e.g., 408-1, 408-2, etc.) in each of the sequences (e.g., 438, 448, 458, etc.) of light source control pulses in FIG. 4F through FIG. 4H may be increased to compensate for the loss of light output between the start time (302-1) and the light source control pulse start time (406).

Most images in a sequence of images (or frames) may not comprise any region that is to be rendered on a display panel with a relatively high (e.g., full, the brightest, the maximum, greater than 90% of the maximum, etc.) brightness and that is (e.g., immediately, etc.) preceded by a relatively low (e.g., dark black, the darkest, the minimum, a relatively small percentile of a dynamic range above the minimum, etc.) luminance level. In these images, light source control waveforms (which may generate different intensities of light output to illuminate different regions of the display panel (102)) such as illustrated in FIG. 4A or FIG. 4E may be used to drive a spatial distribution (e.g., 110 of FIG. 1B or FIG. 1C, etc.) of light sources.

A few images in the sequence of images (or frames) may comprise one or more regions that are to be rendered on a display panel with a relatively high (e.g., full, the brightest, the maximum, greater than 90% of the maximum, etc.) brightness and that is (e.g., immediately, etc.) preceded by a relatively low (e.g., dark black, the darkest, the minimum, a relatively small percentile of a dynamic range above the minimum, etc.) luminance level. In these images, light source control waveforms (which may generate different intensities of light output to illuminate different regions of the display panel (102)) such as illustrated in FIG. 4B through FIG. 4D or FIG. 4F through FIG. 4H may be used to drive a spatial distribution (e.g., 110 of FIG. 1B or FIG. 1C, etc.) of light sources.

In some embodiments, a sequence of light source control pulses that only comprises light source control pulses after the settling time (308) or the light source control pulse start time (406) after the settling time (308) may be constrained in total maximum energy, which may be a sum of all individual maximum energy values of the light source control pulses. For example, an energy (e.g., integration of the light source control pulse amplitude over time for a light source control pulse in a light source control pulse cycle) of a light source control pulse may be limited to a maximum energy value (e.g., limited to no more than a maximum duty factor in PWM, no more than a maximum digitized or coded amplitude in PCM, no more than a maximum modulated frequency in PDM, a combination of the foregoing, etc.). Thus, such a sequence of light source control pulses may be constrained in the maximum light output that can be generated. In some embodiments, a display panel (e.g., 102) may be operated in scenarios in which the display panel (102) is to support (e.g., super) brightness levels higher than supported by the sequence of light source control pulses that only comprises light source control pulses after the settling time (308) or the light source control pulse start time (406) after the settling time (308). For images that has the super brightness levels, a new sequence of light source control pulses can be constructed by growing the sequence of light source control pulses that only comprises light source control pulses after the settling time (308) or the light source control pulse start time (406) after the settling time (308) towards the start time (302-1). Thus, to support these super bright level, the support time interval (or aggregated light source control pulse cycles with light source control pulses of non-zero amplitudes) for the new sequence of light source control pulses may extend before the settling time (308) or the light source control pulse start time (406) after the settling time (308). This may generate some blurs, jitters, etc., in images with motions, depending at least partly on how much light valves changes light output regulation properties and on how much the support time interval extends into a transition time interval (e.g., the time interval from 302-1 to 308 of FIG. 3, etc.) in which the light valves change the light output regulation properties.

FIG. 4I and FIG. 4J illustrate two example light source control waveforms that comprise sequences (e.g., 468, 478, etc.) of light source control pulses extending before the settling time (308) or the light source control pulse start time (406) after the settling time (308).

In some embodiments, as illustrated in FIG. 4I, each light source control pulse (e.g., 470-3, etc.) extending before the settling time (308) or the light source control pulse start time (406) after the settling time (308) in a sequence (468 in the present example) of light source control pulses may comprise the same or similar energy as that of a light source control pulse (e.g., 470-1, 470-2, etc.) not extending before the settling time (308) or the light source control pulse start time (406) after the settling time (308) in the same sequence (468).

In some embodiments, as illustrated in FIG. 4J, a light source control pulse (e.g., 480-3, etc.) extending before the settling time (308) or the light source control pulse start time (406) after the settling time (308) in a sequence (478 in the present example) of light source control pulses may comprise a different energy from that of each of light source control pulses (e.g., 480-1, 480-2, etc.) not extending before the settling time (308) or the light source control pulse start time (406) after the settling time (308) in the same sequence (468). In some embodiments, while an energy of each of the later light source control pulses (e.g., 480-1, 480-2, etc.) may be set to a first (e.g., constant, fixed, similar, within an error tolerance, etc.) value, an energy of the former light source control pulse (e.g., 480-3 etc.) may be set to a second energy value larger than the first energy value. For example, the second energy value for a light source control pulse centered at a specific time (before the settling time (308) or the light source control pulse start time (406) after the settling time (308)) may be set inversely proportional to the difference between the (still transitory) light output regulation property value (of a specific region of a display panel to be illuminated by a light source driven by the sequence (478) of light source control pulses) at the specific time and the first light output regulation property value at the start time (302-1).

An image processing system as described herein may implement light source driving techniques based on PWM, PCM, PDM, etc. In some embodiments, more than one type of driving techniques can be used to construct a single sequence of light source control pulses as described herein. For example, the energy of a light source control pulse in the single sequence of light source control pulses may be set based on multiple driving techniques.

In a non-limiting example, the energy of the light source control pulse can initially be set/adjusted to one of multiple different values by setting/adjusting a duty factor of the light source control pulse to different values. The different values of the duty factor correspond to different lengths of time during which the light source control pulse has a non-zero value (e.g., the length of time of a PWM on-state in a PWM cycle in which the light source control pulse is in). The energy of the light source control pulse can be set/adjusted to one of multiple different values by setting/adjusting a duty factor of the light source control pulse to different values. The different values of the duty factor correspond to different lengths of time during which the light source control pulse has a non-zero amplitude (e.g., the length of time of a PWM on-state in a PWM cycle in which the light source control pulse is in). When the duty factor reaches a maximum value (e.g., 66% of the PWM cycle, 80% of the PWM cycle, etc.), the energy of the light source control pulse can then be set/adjusted to one of multiple different values by setting/adjusting the light source control pulse to different digitized or coded amplitudes (e.g., representing different voltage values used to drive the light source, different electric current values generated in the light source, a 6-bit value, a 4-bit value, etc.).

In another non-limiting example, the energy of the light source control pulse can first be set/adjusted to one of multiple different values by setting/adjusting the light source control pulse to different digitized or coded amplitudes (e.g., representing different voltage values used to drive the light source, different electric current values generated in the light source, etc.). When the duty factor reaches a maximum value (e.g., 66% of the PWM cycle, 80% of the PWM cycle, etc.), the energy of the light source control pulse can then be set/adjusted to one of multiple different values by setting/adjusting a duty factor of the light source control pulse to different values.

Additionally, optionally, or alternatively, the energy of a sequence of light source control pulses as described herein can be set/adjusted to one of multiple different values by setting/adjusting light source control pulse cycles occupied by light source control pulses of non-zero amplitudes; by setting/adjusting the number of clusters, by setting/adjusting the support time interval over which the sequence of light source control pulses is spread; etc.

In some embodiments, the image processing system may be configured to operate with a low power consumption profile for most or all image rendering operations by limiting peak current by spreading light source control pulses over a relatively long support time interval.

For example, the image processing system may use a sequence of light source control pulses such as 402 of FIG. 4A or 412 of FIG. 4E for most image rendering operations and use a sequence of light source control pulses such as 408 of FIG. 4B, 418 of FIG. 4C, 428 of FIG. 4D, 438 of FIG. 4F, 448 of FIG. 4G, 458 of FIG. 4H, etc., when the image processing system determines that there exists at least one region in an image in which a difference between a first light valve control value in a preceding frame and a second light valve control value in a current frame exceeds a light valve control threshold, whether the first light valve control value is greater or smaller than the second light valve control value. Thus, in these embodiments, darkness-to-darkness or brightness-to-brightness transitions in the light valve control in a region of the image do not trigger the image processing system to use a sequence of light source control pulses such as 408 of FIG. 4B, 418 of FIG. 4C, 428 of FIG. 4D, 438 of FIG. 4F, 448 of FIG. 4G, 458 of FIG. 4H, etc.; only darkness-to-brightness or brightness-to-darkness transitions in the light valve control in a region of the image may trigger the image processing system to use a sequence of light source control pulses such as 408 of FIG. 4B, 418 of FIG. 4C, 428 of FIG. 4D, 438 of FIG. 4F, 448 of FIG. 4G, 458 of FIG. 4H, etc., depending on how large the change transition in the light valve control is in the region.

In some embodiments, the image processing system may use a sequence of light source control pulses such as 402 of FIG. 4A or 412 of FIG. 4E for most image rendering operations and use a sequence of light source control pulses such as 408 of FIG. 4B, 418 of FIG. 4C, 428 of FIG. 4D, 438 of FIG. 4F, 448 of FIG. 4G, 458 of FIG. 4H, etc., when the image processing system determines that there exists at least one region in an image in which a difference between a first light valve control value in a preceding frame and a second light valve control value in a current frame exceeds a light valve control threshold, AND when the first light valve control value is smaller than the second light valve control value. Thus, in these embodiments, darkness-to-darkness, brightness-to-brightness, or brightness-to-darkness transitions in the light valve control in a region of the image do not trigger the image processing system to use a sequence of light source control pulses such as 408 of FIG. 4B, 418 of FIG. 4C, 428 of FIG. 4D, 438 of FIG. 4F, 448 of FIG. 4G, 458 of FIG. 4H, etc.; only darkness-to-brightness transitions in the light valve control in a region of the image may trigger the image processing system to use a sequence of light source control pulses such as 408 of FIG. 4B, 418 of FIG. 4C, 428 of FIG. 4D, 438 of FIG. 4F, 448 of FIG. 4G, 458 of FIG. 4H, etc., depending on how large the change transition in the light valve control is in the region.

Examples of types of display panels as described herein include, but are not limited to only, any of: twisted nematic (TN) display panels, vertical alignment (VA) display panels, in-plane switching (IPS) display panels, display panels utilizing phosphorous materials, display panels containing quantum dots, etc.

In some embodiments, a settling time (e.g., 308 of FIG. 3, etc.) can be set to a specific (e.g., constant, pre-configured, worst-case, etc.) value based on the type of display panels. The settling time can be set to different (e.g., constant, pre-configured, worst-case, etc.) values for TN display panels, VA display panels, IPS display panels, etc. For example, in some embodiments, the setting time may be set to a specific first value for some or all of a first type (e.g., TN) of display panels; a specific second value for some or all of a second type (e.g., VA) of display panels; a specific third value for some or all of a second type (e.g., IPS) of display panels; etc.

In some embodiments, a settling time (e.g., 308 of FIG. 3, etc.) can be set to a (e.g., lookup, etc.) value in a specific value range based on the type of display panels. The settling time can be set to a (e.g., lookup, etc.) value in different value ranges for TN (twisted nematic) display panels, VA (vertical alignment) display panels, IPS (in-plane switching) display panels, etc. For example, in some embodiments, the setting time may be looked up in a specific first value range for some or all of a first type (e.g., TN) of display panels based on a first light valve control value and a second light valve control value in a transition of a light valve control; a specific second value for some or all of a second type (e.g., VA) of display panels based on a first light valve control value and a second light valve control value in a transition of a light valve control; a specific third value for some or all of a second type (e.g., IPS) of display panels based on a first light valve control value and a second light valve control value in a transition of a light valve control; etc.

A display panel (e.g., 102) may start rendering different regions of the same image at different start times (represented by different start time values for the start time 302-1 of FIG. 3 and FIG. 4A through FIG. 4H) and end rendering the different regions of the same image at different end times (represented by different end time values for the end time 302-2 of FIG. 3 and FIG. 4A through FIG. 4H).

For example, in some embodiments, a first region of an image that is to be rendered on a first region (e.g., 116-1) of the display panel (102) may be rendered starting at a first start time value for the start time (302-1); a second region of the same image that is to be rendered on a second region (e.g., 116-2) of the display panel (102) may be rendered starting at a second start time value for the start time (302-1), where the second start time value is later than the first start time value for the first region (e.g., 116-1) of the display panel (102); a third region of the same image that is to be rendered on a third region (e.g., 116-3) of the display panel (102) may be rendered starting at a third start time value for the start time (302-1), where the third start time value is later than both the first start time value for the first region (e.g., 116-1) of the display panel (102) and the second start time value for the second region (e.g., 116-2) of the display panel (102); etc. Additionally, optionally, or alternatively, the rendering of the first region of the image may end at a first end time value for the end time (302-2); the rendering of the second region of the same image may end at a second end time value for the end time (302-2), where the second end time value is later than the first end time value; the rendering of the third region of the same image may end at a third end time value for the end time (302-2), where the third end time value is later than both the first end time value and the second end time value; etc.

6. Example System Configurations

Figure 5A:
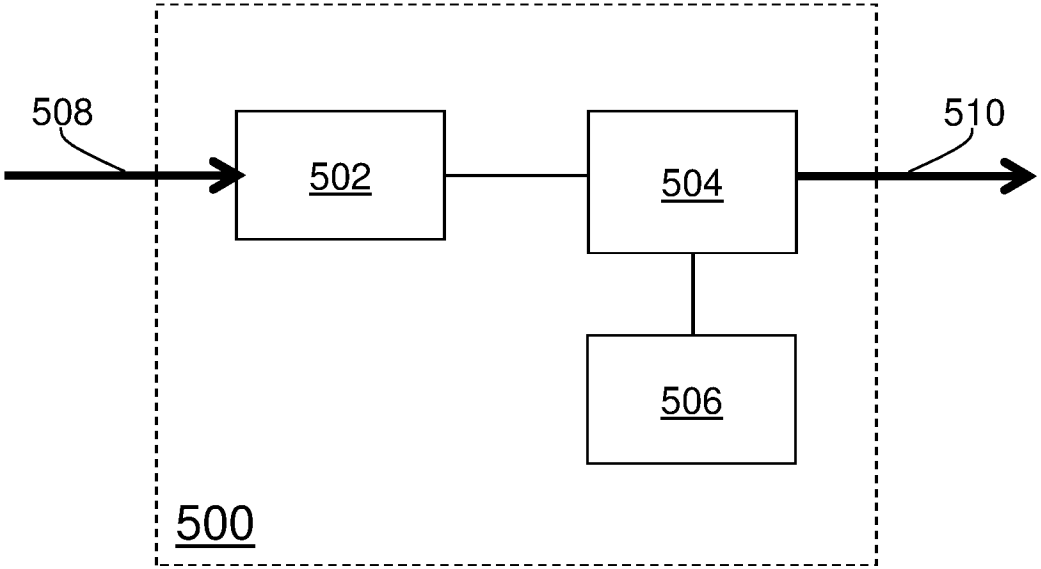
FIG. 5A illustrates an example light source manager.

FIG. 5A illustrates an example light source manager 500 comprising a decoding unit 502, a light source controller 504, a control waveform generator 506, etc. The light source manager (500) may be implemented in software, hardware, a combination of software and hardware, etc., with one or more computing processors. The light source manager (500) can be incorporated in one or more of upstream media devices, downstream media devices, media content servers, set-top boxes, display devices, media stream servers, multimedia devices, media transcoding systems, etc.

In some embodiments, the decoding unit (502) may comprise software, hardware, a combination of software and hardware, etc., configured to receive an input media signal 508, decode or decompress the input media signal (508) into input image data of frames (or input images). The input media signal (508) may be, but is not limited to only, any of: video signals, multi-layer video signals, coded bitstreams, multimedia files, etc.

The input media signal (508) may be encoded with the input image data in a standard-based format, a proprietary format, an extension format based at least in part on a standard-based format, etc. Additionally and/or optionally, the input media signal (508) may comprise image metadata. In some embodiments, the image metadata contains image processing parameters related to but separate from the input image data. Example parameters in the image metadata may include, but are not necessarily limited to only, any of: settling times, start times for frames, offsets from start times for scanlines or portions of frames, numbers of light source control pulse cycles, duty factors in light source control pulses, amplitudes in light source control pulses, modulated frequencies in light source control pulses, media program parameters, scene parameters, frame parameters, luminance parameters, etc.

The input image data may be derived from any of a variety of media content sources such as image acquisition devices, cameras, media content servers, tangible media, studio systems, content databases, etc. Examples of input image data may include, but are not limited to only, any of: raw images, digital photos, video images, 3D images, non-3D images, computer-generated graphics, scene-referred images, device-referred images, images with various dynamic ranges, etc.

The input image data may be coded in any of a variety of color spaces such as one of RGB color spaces. YUV color spaces, YDzDx color spaces, etc. In an example, each pixel value in an image represented in the input image data comprises component pixel values for some or all channels defined in a color space such as red, green and blue color channels in a RGB color space, luma and chroma channels in a YCbCr color space, etc.

In some embodiments, the input image data decoded from the input media signal (508) may comprise reference code values in a code space comprising a wide range of luminance values such as maximum luminance values (or maximum brightness levels) up to 5,000 nits, 12,000 nits, 20,000 nits or more. These reference code values can be perceptually-based or non-perceptually based.

Perceptually-based reference code values may represent quanta (e.g., just noticeable differences or JNDs, etc.) of human perception in a human visual model. In some embodiments, a perceptually-based reference code value is not to be directly read as a physical luminance value, a power value (e.g., gamma compressed or expanded values, etc.) of a physical luminance value, etc. In some embodiments, a perceptually-based reference code value may be converted by a recipient unit (e.g., a target display device, a set-top box, a multimedia device, a light source manager such as 100, etc.) to a physical luminance value, a digitized voltage value, etc., based on a lookup table (LUT), a mapping curve, mapping piece-wise linear line segments, etc.

The input media signal (508) may be received by the light source manager (500) or the decoding unit (502) therein through a data connection. As used herein, a data connection may refer to any of: network connections, digital data interfaces, local data connections, data interfaces with tangible storage media, data connections involving intermediate devices (e.g., transcoders, gateways, routers, switches, etc.), etc.

In some embodiments, the light source controller (504) comprises software, hardware, a combination of software and hardware, etc., configured to receive, from the decoding unit (502), the input image data decoded from the input media signal (508); derive initial intensity images, working resolution intensity images, light source control images, etc., from the image data; etc. In some embodiments, the light source controller (504) may be further configured to derive a light field simulation for a target display panel (e.g., 102, etc.); upsample the light field simulation to the same spatial resolution as per-pixel (or per-subpixel) spatial resolution of the image data of the frame to be rendered on the display panel (102); determine (e.g., per-pixel, per-sub-pixel, per-pixel block, per-region, per-region averaged, per-region aggregated, etc.) light valve control values for each of the frames represented by the input image data; generate light valve control images based on the input image data and the light field simulation; etc.

In some embodiments, the control waveform generator (506) comprises software, hardware, a combination of software and hardware, etc., configured to determine transitions of values of light output regulation properties in different regions of the target display panel (102) for timewise adjacent frames in the frames represented by the input image data, based on the light valve control values determined by the light source controller (504).

In some embodiments, the control waveform generator (506) determines whether a transition of the values of the (e.g., averaged, aggregated, mean, etc.) light valve control in any of the regions of the target display panel (102) between any two timewise adjacent frames in the frames represented by the input image data exceeds a light valve control threshold. If so, the control waveform generator (506) constructs a specific sequence of light source control pulses (e.g., FIG. 4B, FIG. 4C, etc.) to drive a corresponding light source (e.g., designated for illuminating/backlighting the region in which the threshold is exceeded, etc.) for the second frame in the two timewise adjacent frames. Otherwise, if there is no transition of values of the light valve control that exceeds the light valve control threshold, the control waveform generator (506) constructs a default sequence of light source control pulses (e.g., as illustrated in FIG. 4A or FIG. 4E, etc.) to drive the corresponding light source.

In some embodiments, different regions (e.g., 116-1, 116-2 and 116-3 of FIG. 1C, etc.) of the target display panel (102) may be driven by different types of sequences of light source control pulses. For example, a first region (e.g., 116-1 with no transition exceeding the light valve control threshold) of the target display panel (102) may be driven by a default sequence of light source control pulses (e.g., as illustrate in FIG. 4A); a second region (e.g., 116-2 with a transition exceeding the light valve control threshold) may be driven by a non-default sequence of light source control pulses (e.g., as illustrated in FIG. 4B).

In some embodiments, in the same frame, for different regions that transitions of values of light output regulation properties do not exceed the threshold, the same default sequences of light source control pulses (e.g., as illustrated in FIG. 4A) may be used to drive corresponding light sources that illuminate these regions, except that these default sequences may be set different energies or amplitudes or duty factors.

In some embodiments, in the same frame, for different regions that transitions of values of light output regulation properties exceed the threshold, the same non-default sequences of light source control pulses (e.g., as illustrated in FIG. 4B) may be used to drive corresponding light sources that illuminate these regions, except that these non-default sequences may be set different energies or amplitudes or duty factors. In some other embodiments, in the same frame, for different regions that transitions of values of light output regulation properties exceed the threshold, different non-default sequences of light source control pulses (e.g., as illustrated in FIG. 4B and FIG. 4C) may be used to drive corresponding light sources that illuminate these regions; in addition, these non-default sequences may be set different energies or amplitudes or duty factors.

In some embodiments, the control waveform generator (506) may generate light source control data 510 comprising: sequences of light source control pulses for each of the frames represented in the image data, etc.; provide the light source control data (510) to one or more downstream recipient modules (e.g., a television, a target display device, a handheld display, a wall display, an image rendering module in a target display device, a set-top box local to a target display device, etc.); etc. Additionally, optionally, or alternatively, the light source manager (500) may generate and include the light valve control images as a part of the light source control data (510).

In some embodiments, some or all of the sequences of light source control pulses may be adaptively and dynamically constructed dependent on the input image data for which light source control operations as described herein are performed during rendering images represented in the input image data. For example, a target display device may dynamically vary or adapt different sequences of light source control pulses, different energies for light source control pulses in the sequences of light source control pulses, etc., among different images, among different image groups, among different portions of an image, etc., in the input image data.

Techniques as described herein support light source control operations in a variety of system configurations.

Figure 5B:
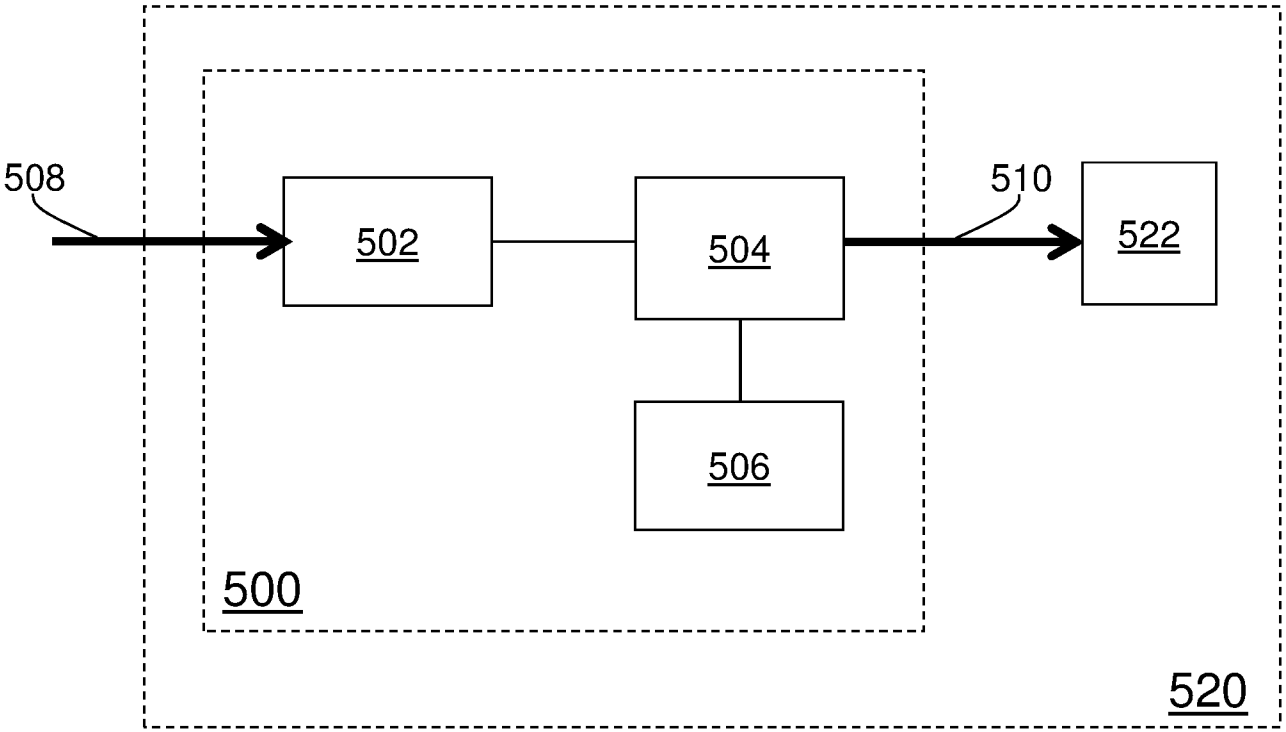
FIG. 5B illustrates an example system configuration in which a target display device incorporates a light source manager.

FIG. 5B illustrates an example system configuration in which a target display device 520 incorporates a light source manager (e.g., 500 of FIG. 5A).

A display device (or a target display device) as described herein may refer to a backlit display, a side-lit display, a projection display, a direct light emitting diode (LED) display, an organic light emitting diode (OLED) display, etc. The display device may comprise pixels such as one or more of liquid crystal display unit structures, pixel or sub-pixel level LEDs, pixel or sub-pixel level OLEDs, etc., that can be used to modulate light transmission and/or light reflection for the purpose of rendering images based on image data.

The display device may be configured to receive an input media signal such as a SDR video signal, an HDR video signal, etc., and perform light source management operations as described herein based at least in part on image data decoded from the input media signal (508).

In some embodiments, the light source controller (504) in the light source manager (500) as incorporated by the target display device (520) of FIG. 5B may distribute the light source control data (510) to a light source driver 522 in the target display device (520). In some embodiments, the light source driver (522) can be implemented as a separate module from the light source manager (500). In some other embodiments, the light source driver (522) can be integrated with the light source manager (500) as a single unified (e.g., backlight, etc.) module.

In some embodiments, the light source driver (522) may comprise software, hardware, a combination of software and hardware, etc., configured to drive light sources (e.g., in the spatial distribution (110), etc.) for the target display device (520) based on sequences of light source control pulses constructed by the light source manager (500) as received in the light source control data (510).

Figure 5C:
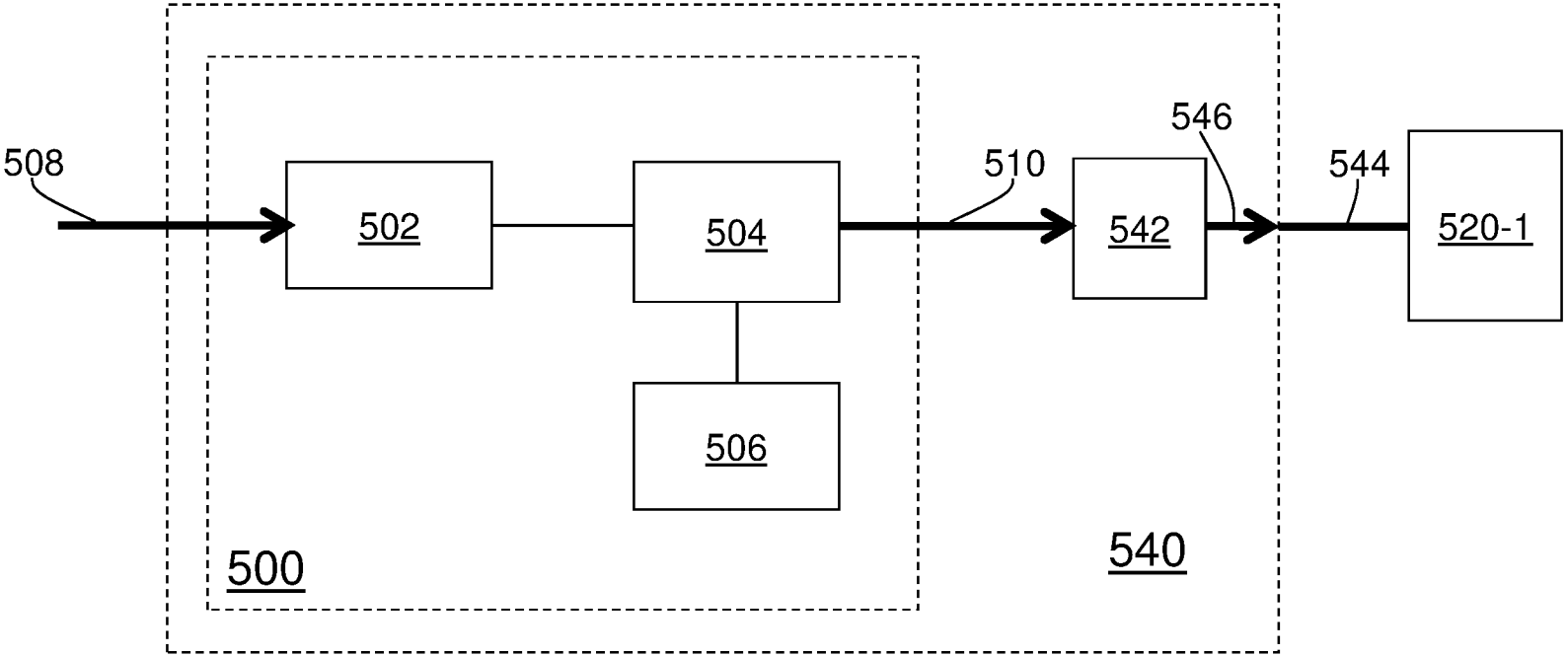
FIG. 5C illustrates an example system configuration in which a set-top box incorporates a light source manager.

FIG. 5C illustrates an example system configuration in which a set-top box 540 incorporates a light source manager (e.g., 500 of FIG. 5A).

In some embodiments, the light source controller (504) in the light source manager (500) as incorporated by the set-top box (540) may distribute the light source control data (510) to an encoding module 542 in the set-top box (540). In some embodiments, the encoding module (542) can be implemented as a separate module from the light source manager (500). In some other embodiments, the encoding module (542) can be integrated as with the light source manager (500) as a single unified (e.g., light source control, etc.) module.

In some embodiments, the encoding module (542) may comprise software, hardware, a combination of software and hardware, etc., configured to encode the light source control data (510), which have been adapted for a target display device 520-1 based on sequences of light source control pulses specifically set up for the target display device (520-1), into as a part of an output media signal 546. Additionally, optionally, or alternatively, the light valve control images (e.g., as a part of the light source control data (510), etc.) are included in the output media signal (546). The encoding module (542) transmits the output media signal (546) over a data connection 544 to a target display device 520-1 for rendering images represented in the input image data of the frames. The set-top box (540) may, but is not limited to, be local to the target display device (540-1).

In some embodiments, a light source driver may be incorporated by at least one of the set-top box (540) or the target display device (520-1). The light source driver may be configured to drive light sources (e.g., in the spatial distribution (110), etc.) for the target display device (520-1) based on sequences of light source control pulses constructed by the light source manager (500) as received in the light source control data (510).

Figure 5D:
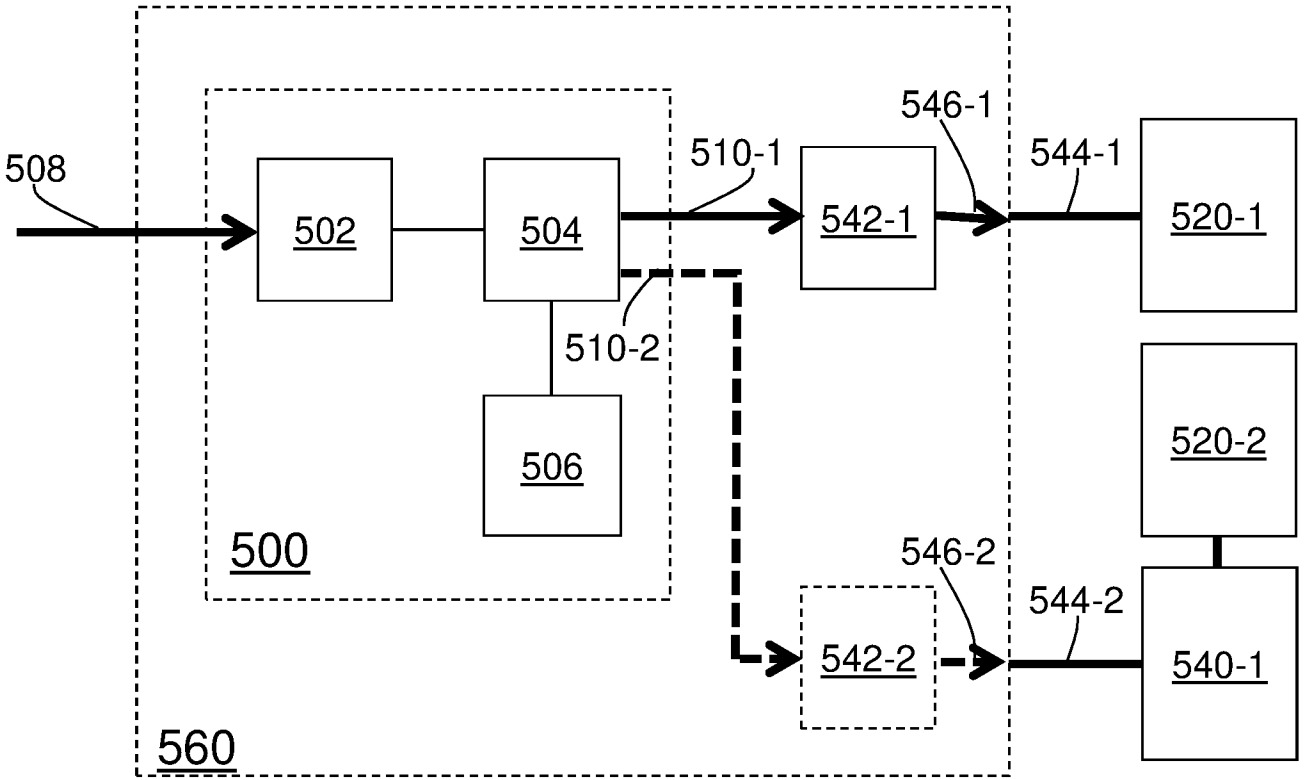
FIG. 5D illustrates an example system configuration in which an upstream device incorporates a light source manager.

FIG. 5D illustrates an example system configuration in which an upstream device 560 (e.g., a cloud based system located remotely from a target display device or from a target display panel, etc.) incorporates a light source manager (e.g., 500 of FIG. 5A). The upstream device (560) may be a media source device, an upstream media encoder, an upstream media transcoder, etc., located remotely from one or more downstream devices such as a target display device 520-1, a set-top box 540-1, etc. In some embodiments, the set-top box (540-1) may be communicatively linked (e.g., via a HDMI connection, etc.) with a second target display device 540-2.

A decoding unit (e.g., 502 of FIG. 5A, etc.) in the upstream device (560) may receive an input media signal (e.g., 508, etc.), decode input media content from the input media signal (508), etc.

A light source controller (e.g., 504 of FIG. 5A, etc.) may be configured to transform the input media content, as decoded by the decoding unit (502) from the input media signal (508), into one or more versions of light source control data. For example, a first version 510-1 of the light source control data is generated from the input media content specifically for the first target display device (520-1). A second version 510-2 of the light source control data is generated from the input media content specifically for the second target display device (520-2).

Additionally, optionally, or alternatively, the light source manager (500) may generate and include a first version of light valve control images specifically determined for the first target display device (520-1) as a part of the first version (510-1) of the light source control data. Likewise, the light source manager (500) may generate and include a second version of light valve control images specifically determined for the second target display device (520-2) as a part of the second version (510-2) of the light source control data.

Each of the one or more versions (e.g., 510-1, 510-2, etc.) of the light source control data may be encoded by an encoding unit (e.g., 542-1, 542-2, etc.) into a corresponding output media signal (e.g., 546-1, 546-2, etc.). For example, the first version (510-1) of the light source control data may be encoded into a first output media signal 546-1; the second version (510-2) of the light source control data may be encoded into a second output media signal 546-1.

Each of the output media signals (e.g., 546-1 and 546-2, etc.) may be transmitted or distributed electronically by the upstream device (560) over one or more data connections (e.g., 544-1, 544-2, etc.) to one or more downstream devices, respectively. For example, the first output media signal (546-1) may be transmitted over a first data connection 546-1 to the target display device (520-1); the second output media signal (546-2) may be transmitted over a second data connection 546-2 to the set-top box (540-1), etc.

In some embodiments, the set-top box (540-1) may be configured to forward or relay the second output media signal (546-2) to the second target display device (520-2). In some other embodiments, the set-top box (540-1) may perform additional conversions, additional image processing operations, etc., on the second output media signal (546-2) to generate a new output media signal and send the new output media signal, in place of or in addition to the second output media signal (546-2), to a downstream device such as the second target display device (540-2), etc.

Additionally, optionally or alternatively, preprocessing and post processing steps (which may include, but are not limited only to, color space conversion, down sampling, upsampling, tone mapping, color grading, decompression, compression, etc.) may be performed by one or more of the upstream device (240), the set-top box (220-1), the target display devices (e.g., 520-1, 520-2, etc.), etc.

7. Example Process Flow

Figure 6A:
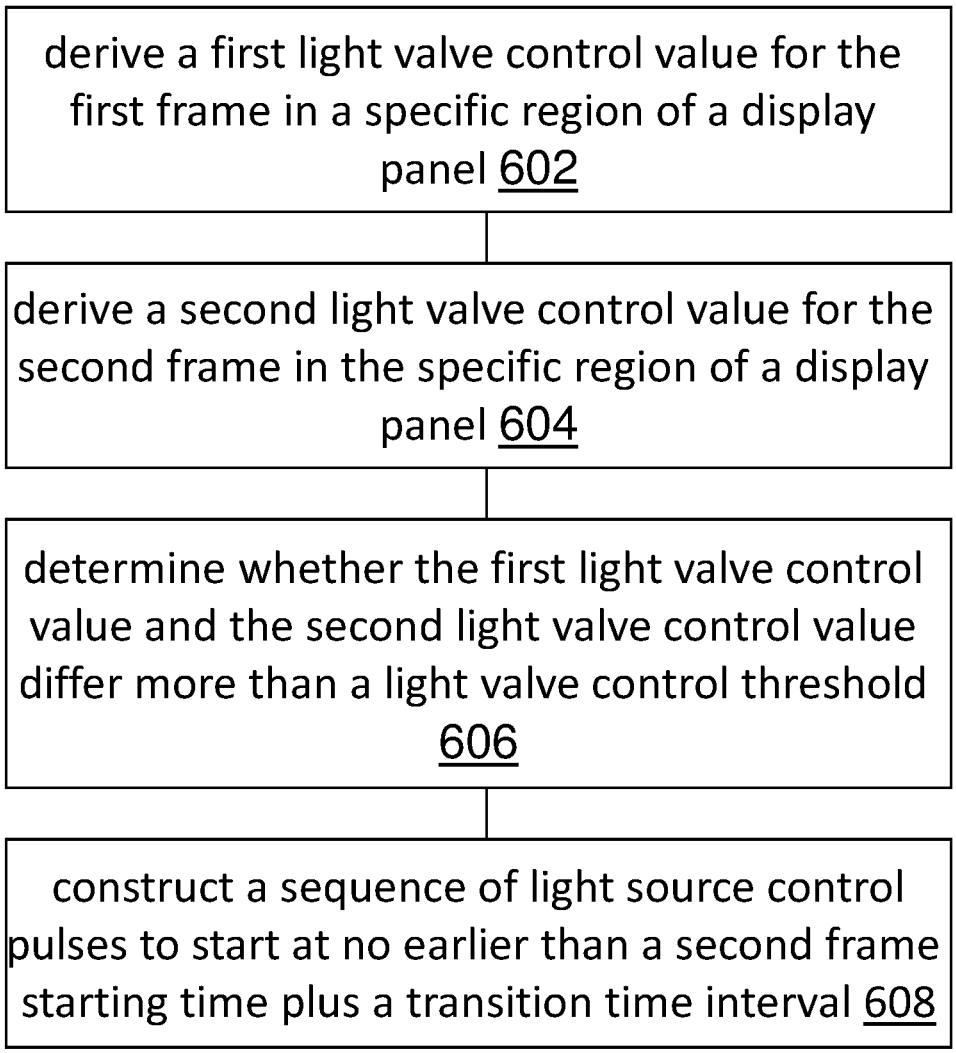
FIG. 6A and FIG. 6B illustrate example process flows.

FIG. 6A illustrates an example process flow. In some embodiments, one or more computing devices or components such as a light source manager 500 of FIG. 5A, a display device (520), a set-top box (540), an upstream device (560), etc., may perform this process flow. In some embodiments, the light source manager (500) receives image data for a sequence of frames.

In block 602, the light source manager (500) derives, based at least in part on first image data of a first frame, a first light valve control value for the first frame in a specific region of a display panel, the first image data of the first frame being rendered on the display panel starting at a first frame time.

In block 604, the light source manager (500) derives, based at least in part on second image data of a second frame that immediately follows the first frame in time, a second light valve control value for the second frame in the specific region of the display panel, the second image data of the second frame being rendered on the display panel starting at a second frame time.

In block 606, the light source manager (500) determines whether a difference between the first light valve control value and the second light valve control value exceeds a light valve control threshold.

In block 608, the light source manager (500), in response to determining that the difference between the first light valve control value and the second light valve control value exceeds the light valve control threshold, performs: constructing a light source driving waveform that comprises a sequence of light source control pulses for controlling one or more light sources designated to illuminate the specific region of the display panel, the sequence of light source control pulses being constrained to start at a start time (e.g., 302-1 of FIG. 3 and FIG. 4A through FIG. 4K, etc.) plus a transition time interval (e.g., the time interval from 302-1 to 308 of FIG. 3 and FIG. 4A through FIG. 4K, etc.), the start time being no earlier than the second frame starting time, the transition time interval allowing one or more light valves in the specific region of the display panel to complete a transition from the first light valve control value for the first frame to the second light valve control value for the second frame, a temporal average position of the sequence of light source control pulses being constrained to be centered at a fixed time interval after the start time; etc.

In an embodiment, the fixed time interval is one half of a frame time interval.

In an embodiment, the one or more light sources are driven with a previous sequence of light source control pulses for rendering the first image data of the first frame on the display panel; the previous sequence of light source control pulses is constrained to be start at a previous start time plus the transition time interval; a previous temporal average position of the previous sequence of light source control pulses is constrained to be centered the fixed time interval after the previous start time.

In an embodiment, the start time represents a time point, after the second frame time, when individual light valves in the specific region of the display panel start to be scanned based on individual light valve control codewords derived from the second image data of the second frame; the second light valve control value represents a group value of the individual light valve control codewords used to scan the individual light valves in the specific region of the display panel.

The light source manager (500) can be configured to drive, or cause driving, the one or more light sources with the sequence of light source control pulses in the light source driving waveform as a part of rendering the second image data of the second frame on the target display panel.

In an embodiment, the sequence of light source control pulses is constructed based at least in part on intensity data that is derived from downsampled image data from the second image data of the second frame.

In an embodiment, the second image data comprises perceptually quantized code values.

In an embodiment, the second image data comprises non-perceptually quantized code values.

In an embodiment, the light source manager (500) is further configured to perform: deriving, based at least in part on the first image data of the first frame, a third light valve control value in a second specific region of the display panel; deriving, based at least in part on the second image data of the second frame, a fourth light valve control value in the second specific region of the display panel; determining whether a second difference between the third light valve control value and the fourth light valve control value exceeds the light valve control threshold; in response to determining that the second difference between the third light valve control value and the fourth light valve control value does not exceed the light valve control threshold, performing: determining a second light source driving waveform that comprises a second sequence of light source control pulses for controlling one or more second light sources that are designated to illuminate the second specific region of the display panel, the second sequence of light source control pulses starting at a second start time plus the transition time interval, the second start time being earlier than the second frame starting time; driving the one or more second light sources with the second sequence of light source control pulses in the second light source driving waveform as a part of rendering the second image data of the second frame on the display panel; etc.

In an embodiment, light output from the one or more light sources as driven with the sequence of light source control pulses integrates to a specific brightness for illumination light onto the one or more light valves in the specific region of the display panel; the specific brightness is determined based on intensity data derived from downsampled image data from the second image data of the second frame.

In an embodiment, the transition time interval is set based at least in part on one or more settling times for one or more types of the one or more light valves in the display panel to change from a lowest light output level to a highest light output level given a constant intensity illumination light.

In an embodiment, the transition time interval is set based at least in part on one or more settling times for one or more types of the one or more light valves in the display panel to change from the first light valve control value for the first frame to the second light valve control value for the second frame.

In an embodiment, the one or more light valves represent one or more liquid crystal display pixels.

In an embodiment, a difference between the first frame start time and the second frame start time represents a frame time interval corresponding to a fixed number of display refreshes at a display refresh rate between 30 Hz to 360 Hz. In an embodiment, the fixed number is one of one, two, three, four, five, six, or more than six. In an embodiment, the sequence of light source control pulses in the light source driving waveform starts at a fraction of the frame time interval after the start time: the fraction of the frame time interval represents a time interval between 1/10 of the frame time interval and 3/4 of the frame time interval. In an embodiment, the sequence of light source control pulses in the light source driving waveform comprises one or more light source control pulse clusters.

In an embodiment, the light source manager (500) is further configured to perform: deriving, based at least in part on the first image data of the first frame, a third light valve control value in a second specific region of the display panel; deriving, based at least in part on the second image data of the second frame, a fourth light valve control value in the second specific region of the display panel; determining whether a second difference between the third light valve control value and the fourth light valve control value exceeds the light valve control threshold; in response to determining that the second difference between the third light valve control value and the fourth light valve control value exceeds the light valve control threshold, performing: constructing a second light source driving waveform that comprises a second sequence of light source control pulses for controlling one or more second light sources that are designated to illuminate the second specific region of the display panel, the second sequence of light source control pulses being constrained to start at a second start time plus a second transition time interval, the second start time being no earlier than the second frame starting time, the second transition time interval allowing one or more second light valves in the second specific region of the display panel to complete a transition from the third light valve control value for the first frame to the fourth light valve control value for the second frame, a temporal average position of the second sequence of light source control pulses being constrained to be centered at the fixed time interval after the second start time; driving the one or more second light sources with the second sequence of light source control pulses in the second light source driving waveform as a part of rendering the second image data of the second frame on the display panel; etc.

In an embodiment, the sequence of light source control pulses has a different number of light source control pulses as compared with the second sequence of light source control pulses. In an embodiment, the sequence of light source control pulses has a same number of light source control pulses as compared with the second sequence of light source control pulses; a duty factor of a light source control pulse in the sequence of light source control pulses has a different value between 0 percent to 100 percent as compared with a duty factor of a corresponding light source control pulse in the second sequence of light source control pulses. In an embodiment, the sequence of light source control pulses has a same number of light source control pulses as compared with the second sequence of light source control pulses; an amplitude of a light source control pulse in the sequence of light source control pulses has a different value as compared with an amplitude of a corresponding light source control pulse in the second sequence of light source control pulses. In an embodiment, the first transition time interval is same as the second transition time interval. In an embodiment, the first transition time interval is different from the second transition time interval.

In an embodiment, the one or more light sources represents one or more light emitting diodes (LEDs) in a set of LEDs disposed behind a plane of the display panel and positioned to backlight light valves in the display panel with an approximation of image content of a frame to be rendered by light from the light valves of the display panel.

In an embodiment, the method is performed by one or more computing devices remote to the target display panel.

In an embodiment, the method is performed by one or more computing devices local to the target display panel.

In an embodiment, the light source driving waveform including the sequence of light source control pulses is saved in one or more non-transitory storage media as image rendering data for rendering image data of the sequence of frames on the target display panel.

Figure 6B:
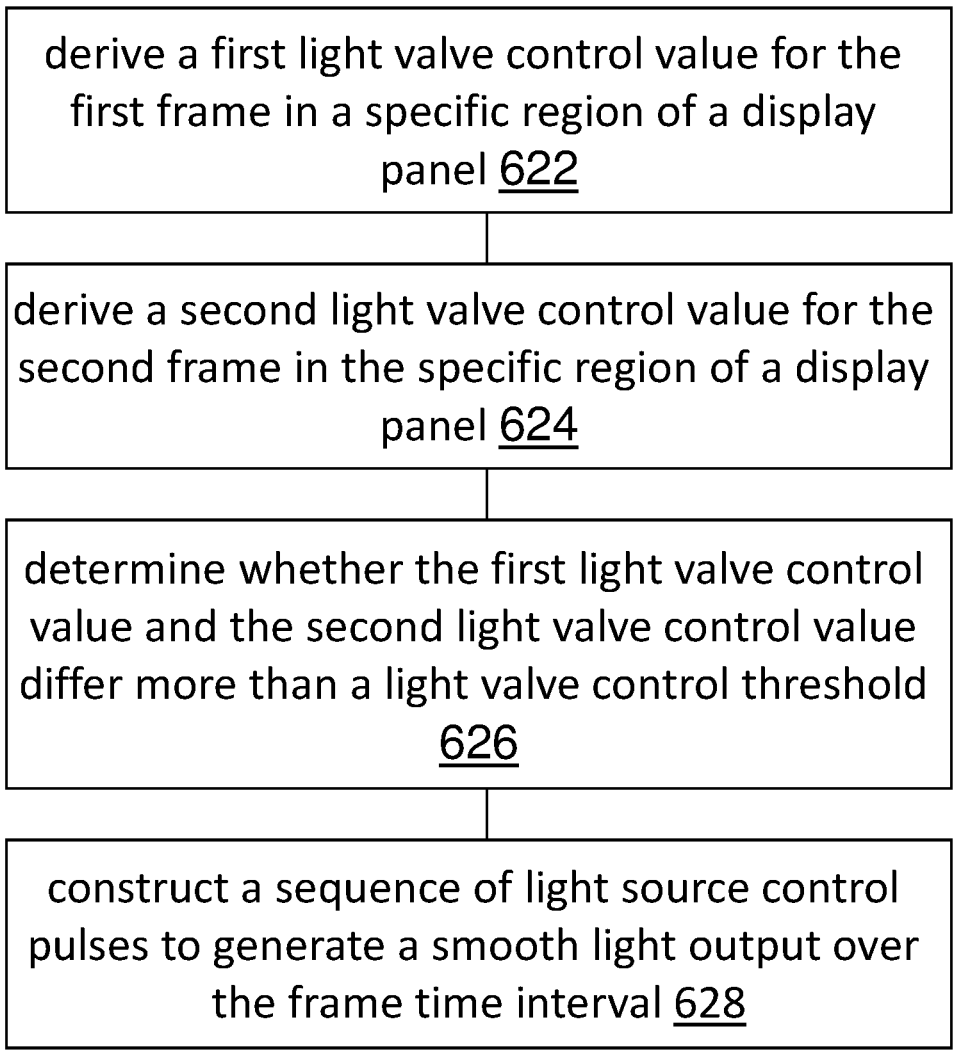

FIG. 6B illustrates an example process flow. In some embodiments, one or more computing devices or components such as a light source manager 500 of FIG. 5A, a display device (520), a set-top box (540), an upstream device (560), etc., may perform this process flow.

In block 622, the light source manager (500) derives, based at least in part on the first image data of the first frame, a first light valve control value in a specific region of a target display panel.

In block 624, the light source manager (500) derives, based at least in part on the second image data of the second frame, a second light valve control value in the specific region of the target display panel.

In block 626, the light source manager (500) determines whether a difference between the first light valve control value and the second light valve control value exceeds a light valve control threshold.

In block 628, the light source manager (500), in response to determining that the difference between the first light valve control value and the second light valve control value exceeds the light valve control threshold, performs: determining time-dependent light output regulation property values in the specific region of the display panel within a frame time interval that starts at the second frame start time; based on the time-dependent light output regulation property values in the specific region of the display panel, constructing a light source driving waveform that comprises a sequence of light source control pulses, the sequence of light source control pulses being constrained to generate a smooth light output over the frame time interval; causing driving one or more light sources that are designated to illuminate the specific region with the sequence of light source control pulses in the light source driving waveform as a part of rendering the second image data of the second frame on the display panel; etc.

In some embodiments, process flows involving operations, methods, etc., as described herein can be performed through one or more computing devices or units.

In an embodiment, an apparatus comprises a processor and is configured to perform any of these operations, methods, process flows, etc.

In an embodiment, a non-transitory computer readable storage medium, storing software instructions, which when executed by one or more processors cause performance of any of these operations, methods, process flows, etc.

In an embodiment, a computing device comprising one or more processors and one or more storage media storing a set of instructions which, when executed by the one or more processors, cause performance of any of these operations, methods, process flows, etc.

Note that, although separate embodiments are discussed herein, any combination of embodiments and/or partial embodiments discussed herein may be combined to form further embodiments.

8. Implementation Mechanisms—Hardware Overview

According to one embodiment, the techniques described herein are implemented by one or more special-purpose computing devices. The special-purpose computing devices may be hard-wired to perform the techniques, or may include digital electronic devices such as one or more application-specific integrated circuits (ASICs) or field programmable gate arrays (FPGAs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices or any other device that incorporates hard-wired and/or program logic to implement the techniques.

Figure 7:
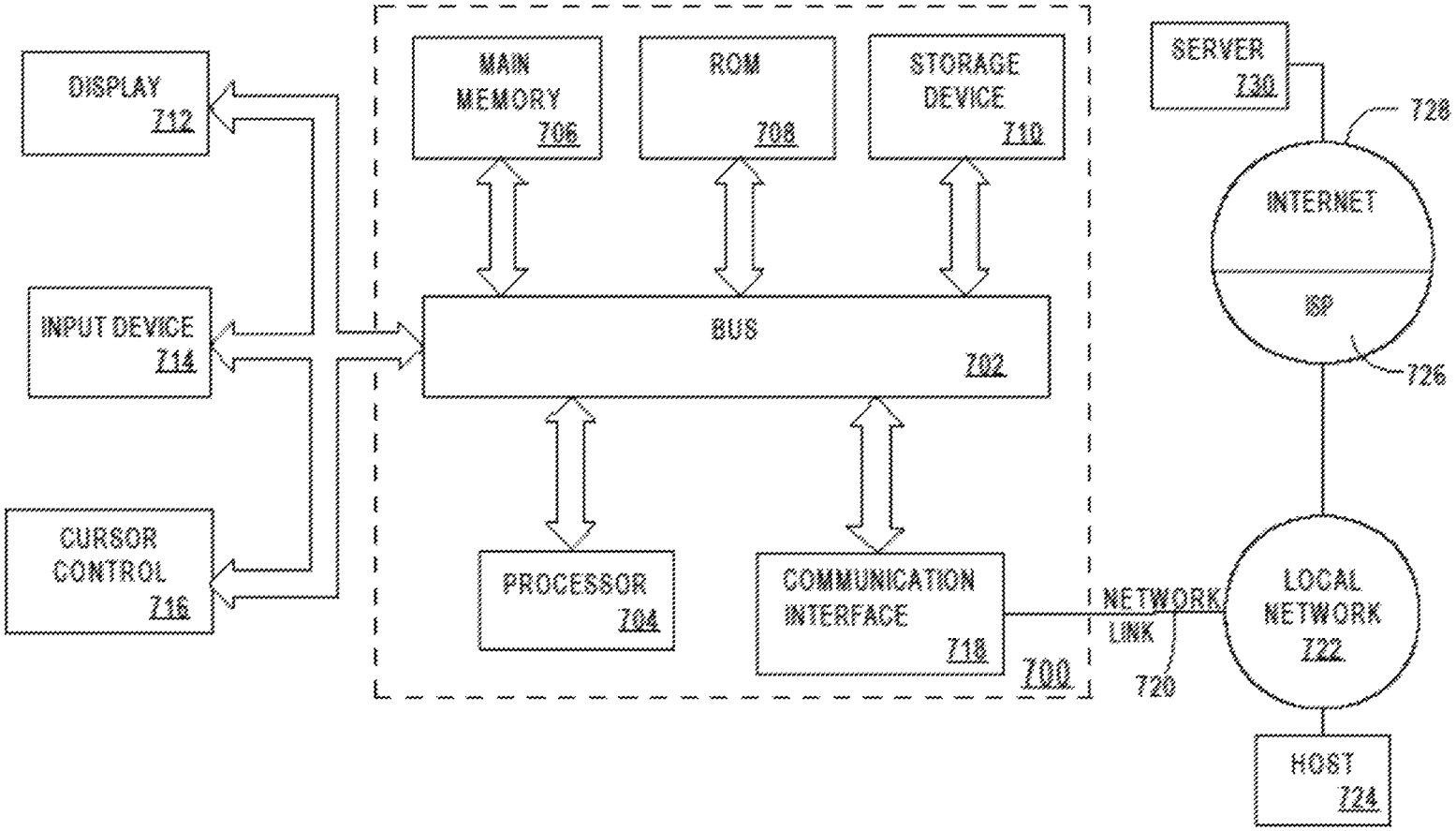
FIG. 7 illustrates an example hardware platform on which a computer or a computing device as described herein may be implemented, according a possible embodiment of the present invention.

For example, FIG. 7 is a block diagram that illustrates a computer system 700 upon which an embodiment of the invention may be implemented. Computer system 700 includes a bus 702 or other communication mechanism for communicating information, and a hardware processor 704 coupled with bus 702 for processing information. Hardware processor 704 may be, for example, a general purpose microprocessor.

Computer system 700 also includes a main memory 706, such as a random access memory (RAM) or other dynamic storage device, coupled to bus 702 for storing information and instructions to be executed by processor 704. Main memory 706 also may be used for storing temporary variables or other intermediate information during execution of instructions to be executed by processor 704. Such instructions, when stored in non-transitory storage media accessible to processor 704, render computer system 700 into a special-purpose machine that is customized to perform the operations specified in the instructions.

Computer system 700 further includes a read only memory (ROM) 708 or other static storage device coupled to bus 702 for storing static information and instructions for processor 704. A storage device 710, such as a magnetic disk or optical disk, is provided and coupled to bus 702 for storing information and instructions.

Computer system 700 may be coupled via bus 702 to a display 712, such as a liquid crystal display, for displaying information to a computer user. An input device 714, including alphanumeric and other keys, is coupled to bus 702 for communicating information and command selections to processor 704. Another type of user input device is cursor control 716, such as a mouse, a trackball, or cursor direction keys for communicating direction information and command selections to processor 704 and for controlling cursor movement on display 712. This input device typically has two degrees of freedom in two axes, a first axis (e.g., x) and a second axis (e.g., y), that allows the device to specify positions in a plane.

Computer system 700 may implement the techniques described herein using customized hard-wired logic, one or more ASICs or FPGAs, firmware and/or program logic which in combination with the computer system causes or programs computer system 700 to be a special-purpose machine. According to one embodiment, the techniques as described herein are performed by computer system 700 in response to processor 704 executing one or more sequences of one or more instructions contained in main memory 706. Such instructions may be read into main memory 706 from another storage medium, such as storage device 710. Execution of the sequences of instructions contained in main memory 706 causes processor 704 to perform the process steps described herein. In alternative embodiments, hard-wired circuitry may be used in place of or in combination with software instructions.

The term "storage media" as used herein refers to any non-transitory media that store data and/or instructions that cause a machine to operation in a specific fashion. Such storage media may comprise non-volatile media and/or volatile media. Non-volatile media includes, for example, optical or magnetic disks, such as storage device 710. Volatile media includes dynamic memory, such as main memory 706. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge.

Storage media is distinct from but may be used in conjunction with transmission media. Transmission media participates in transferring information between storage media. For example, transmission media includes coaxial cables, copper wire and fiber optics, including the wires that comprise bus 702. Transmission media can also take the form of acoustic or light waves, such as those generated during radio-wave and infra-red data communications.

Various forms of media may be involved in carrying one or more sequences of one or more instructions to processor 704 for execution. For example, the instructions may initially be carried on a magnetic disk or solid state drive of a remote computer. The remote computer can load the instructions into its dynamic memory and send the instructions over a telephone line using a modem. A modem local to computer system 700 can receive the data on the telephone line and use an infra-red transmitter to convert the data to an infra-red signal. An infra-red detector can receive the data carried in the infra-red signal and appropriate circuitry can place the data on bus 702. Bus 702 carries the data to main memory 706, from which processor 704 retrieves and executes the instructions. The instructions received by main memory 706 may optionally be stored on storage device 710 either before or after execution by processor 704.

Computer system 700 also includes a communication interface 718 coupled to bus 702. Communication interface 718 provides a two-way data communication coupling to a network link 720 that is connected to a local network 722. For example, communication interface 718 may be an integrated services digital network (ISDN) card, cable modem, satellite modem, or a modem to provide a data communication connection to a corresponding type of telephone line. As another example, communication interface 718 may be a local area network (LAN) card to provide a data communication connection to a compatible LAN. Wireless links may also be implemented. In any such implementation, communication interface 718 sends and receives electrical, electromagnetic or optical signals that carry digital data streams representing various types of information.

Network link 720 typically provides data communication through one or more networks to other data devices. For example, network link 720 may provide a connection through local network 722 to a host computer 724 or to data equipment operated by an Internet Service Provider (ISP) 726. ISP 726 in turn provides data communication services through the world wide packet data communication network now commonly referred to as the "Internet" 728. Local network 722 and Internet 728 both use electrical, electromagnetic or optical signals that carry digital data streams. The signals through the various networks and the signals on network link 720 and through communication interface 718, which carry the digital data to and from computer system 700, are example forms of transmission media.

Computer system 700 can send messages and receive data, including program code, through the network(s), network link 720 and communication interface 718. In the Internet example, a server 730 might transmit a requested code for an application program through Internet 728, ISP 726, local network 722 and communication interface 718.

The received code may be executed by processor 704 as it is received, and/or stored in storage device 710, or other non-volatile storage for later execution.

9. Equivalents, Extensions, Alternatives and Miscellaneous

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A method comprising:

deriving, based at least in part on first image data of a first frame, a first light valve control value for the first frame in a specific region of a display panel, the first image data of the first frame being rendered on the display panel starting at a first frame time;

deriving, based at least in part on second image data of a second frame that immediately follows the first frame in time, a second light valve control value for the second frame in the specific region of the display panel, the second image data of the second frame being rendered on the display panel starting at a second frame time;

determining whether a difference between the first light valve control value and the second light valve control value exceeds a light valve control threshold;

in response to determining that the difference between the first light valve control value and the second light valve control value exceeds the light valve control threshold, performing:

constructing a light source driving waveform that comprises a sequence of light source control pulses for controlling one or more light sources designated to illuminate the specific region of the display panel, the sequence of light source control pulses being constrained to start at a start time plus a transition time interval, the start time being no earlier than the second frame starting time, the transition time interval allowing one or more light valves in the specific region of the display panel to complete a transition from the first light valve control value for the first frame to the second light valve control value for the second frame, a temporal average position of the sequence of light source control pulses being constrained to be centered at a fixed time interval after the start time, wherein the temporal average position of the sequence of light source control pulses is derived based on averaging individual time points of individual light source control pulses in the sequence of light source control pulses with non-zero amplitudes using energies of the individual time points as weight factors;

driving the one or more light sources with the sequence of light source control pulses in the light source driving waveform as a part of rendering the second image data of the second frame on the display panel.

2. The method of claim 1, wherein the fixed time interval is one half of a frame time interval.

3. The method of claim 1, wherein the one or more light sources are driven with a previous sequence of light source control pulses for rendering the first image data of the first frame on the display panel, wherein the previous sequence of light source control pulses is constrained to start at a previous start time plus the transition time interval, and wherein a previous temporal average position of the previous sequence of light source control pulses is constrained to be centered at the fixed time interval after the previous start time.

4. The method of claim 1, wherein the start time represents a time point, after the second frame time, when individual light valves in the specific region of the display panel start to be scanned based on individual light valve control codewords derived from the second image data of the second frame, and wherein the second light valve control value represents a group value of the individual light valve control codewords used to scan the individual light valves in the specific region of the display panel.

5. The method of claim 1, wherein the sequence of light source control pulses is constructed based at least in part on intensity data that is derived from downsampled image data from the second image data of the second frame.

6. The method of claim 1, wherein the second image data comprises perceptually quantized code values.

7. The method of claim 1, wherein the second image data comprises non-perceptually quantized code values.

8. The method of claim 1, further comprising:

deriving, based at least in part on the first image data of the first frame, a third light valve control value in a second specific region of the display panel;

deriving, based at least in part on the second image data of the second frame, a fourth light valve control value in the second specific region of the display panel;

determining whether a second difference between the third light valve control value and the fourth light valve control value exceeds the light valve control threshold;

in response to determining that the second difference between the third light valve control value and the fourth light valve control value does not exceed the light valve control threshold, performing:

determining a second light source driving waveform that comprises a second sequence of light source control pulses for controlling one or more second light sources that are designated to illuminate the second specific region of the display panel, the second sequence of light source control pulses starting before a second start time plus the transition time interval, the second start time being earlier than the second frame starting time;

driving the one or more second light sources with the second sequence of light source control pulses in the second light source driving waveform as a part of rendering the second image data of the second frame on the display panel.

9. The method of claim 1, wherein light output from the one or more light sources as driven with the sequence of light source control pulses integrates to a specific brightness for illumination light onto the one or more light valves in the specific region of the display panel; and wherein the specific brightness is determined based on intensity data derived from downsampled image data from the second image data of the second frame.

10. The method of claim 1, wherein the transition time interval is set based at least in part on one or more settling times for one or more types of the one or more light valves in the display panel to change from a specific lowest light output level to a specific highest light output level given a constant intensity illumination light.

11. The method of claim 1, wherein the transition time interval is set based at least in part on one or more settling times for one or more types of the one or more light valves in the display panel to change from the first light valve control value for the first frame to the second light valve control value for the second frame.

12. The method of claim 1, wherein the one or more light valves represent one or more liquid crystal display pixels.

13. The method of claim 1, wherein a difference between the first frame start time and the second frame start time represents a frame time interval corresponding to a fixed number of display refreshes at a display refresh rate between 30 Hz to 360 Hz.

14. The method of claim 13, wherein the fixed number is one of one, two, three, four, five, six, or more than six.

15. The method of claim 13, wherein the sequence of light source control pulses in the light source driving waveform starts at a fraction of the frame time interval after the start time; and wherein the fraction of the frame time interval represents a time interval between 1/10 of the frame time interval and 3/4 of the frame time interval.

16. The method of claim 13, wherein the sequence of light source control pulses in the light source driving waveform comprises one or more light source control pulse clusters.

17. The method of claim 1, further comprising:

deriving, based at least in part on the first image data of the first frame, a third light valve control value in a second specific region of the display panel;

deriving, based at least in part on the second image data of the second frame, a fourth light valve control value in the second specific region of the display panel;

determining whether a second difference between the third light valve control value and the fourth light valve control value exceeds the light valve control threshold;

in response to determining that the second difference between the third light valve control value and the fourth light valve control value exceeds the light valve control threshold, performing:

constructing a second light source driving waveform that comprises a second sequence of light source control pulses for controlling one or more second light sources that are designated to illuminate the second specific region of the display panel, the second sequence of light source control pulses being constrained to start at a second start time plus a second transition time interval, the second start time being no earlier than the second frame starting time, the second transition time interval allowing one or more second light valves in the second specific region of the display panel to complete a transition from the third light valve control value for the first frame to the fourth light valve control value for the second frame, a temporal average position of the second sequence of light source control pulses being constrained to be centered at the fixed time interval after the second start time;

driving the one or more second light sources with the second sequence of light source control pulses in the second light source driving waveform as a part of rendering the second image data of the second frame on the display panel.

18. The method of claim 17, wherein the sequence of light source control pulses has a different number of light source control pulses as compared with the second sequence of light source control pulses.

19. The method of claim 17, wherein the sequence of light source control pulses has a same number of light source control pulses as compared with the second sequence of light source control pulses; and wherein a duty factor of a light source control pulse in the sequence of light source control pulses has a different value between 0 percent to 100 percent as compared with a duty factor of a corresponding light source control pulse in the second sequence of light source control pulses.

20. The method of claim 17, wherein the sequence of light source control pulses has a same number of light source control pulses as compared with the second sequence of light source control pulses; and wherein an amplitude of a light source control pulse in the sequence of light source control pulses has a different value as compared with an amplitude of a corresponding light source control pulse in the second sequence of light source control pulses.

21. The method of claim 17, wherein the first transition time interval is same as the second transition time interval.

22. The method of claim 17, wherein the first transition time interval is different from the second transition time interval.

23. The method of claim 1, wherein the one or more light sources represents one or more light emitting diodes (LEDs) in a set of LEDs disposed behind a plane of the display panel and positioned to backlight light valves in the display panel with an approximation of image content of a frame to be rendered by light from the light valves of the display panel.

24. A method comprising:

receiving image data for a sequence of frames, the image data for the sequence of frames having first image data of a first frame and second image data of a second frame immediately following the first frame, the first image data of the first frame being rendered on the display panel starting at a first frame time, the second image data of the second frame being rendered on the display panel starting at a second frame time;

deriving, based at least in part on the first image data of the first frame, a first light valve control value in a specific region of a target display panel;

deriving, based at least in part on the second image data of the second frame, a second light valve control value in the specific region of the target display panel;

determining whether a difference between the first light valve control value and the second light valve control value exceeds a light valve control threshold;

in response to determining that the difference between the first light valve control value and the second light valve control value exceeds the light valve control threshold, performing:

constructing a light source driving waveform that comprises a sequence of light source control pulses for controlling one or more light sources that are designated to illuminate the specific region of the target display panel, the sequence of light source control pulses being constrained to start at a start time plus a transition time interval, the start time being no earlier than the second frame starting time, the transition time interval allowing one or more light valves in the specific region of the target display panel to complete a transition from the first light valve control value for the first frame to the second light valve control value for the second frame, a temporal average position of the sequence of light source control pulses being constrained to be centered at a fixed time interval after the start time, wherein the temporal average position of the sequence of light source control pulses is derived based on averaging individual time points of individual light source control pulses in the sequence of light source control pulses with non-zero amplitudes using energies of the individual time points as weight factors;

causing the one or more light sources to be driven with the sequence of light source control pulses in the light source driving waveform as a part of rendering the second image data of the second frame on the target display panel.

25. The method of claim 24, wherein the method is performed by one or more computing devices remote to the target display panel.

26. The method of claim 24, wherein the method is performed by one or more computing devices local to the target display panel.

27. The method of claim 24, wherein the light source driving waveform including the sequence of light source control pulses is saved in one or more non-transitory storage media as image rendering data for rendering image data of the sequence of frames on the target display panel.

* * * * *